US011639622B2

(12) United States Patent
Rush

(10) Patent No.: US 11,639,622 B2
(45) **Date of Patent: *May 2, 2023**

(54) DEFENSE MOBILE DEVICE HAVING A RELEASE SYSTEM FOR SHELTER-IN-PLACE SITUATIONS

(71) Applicant: Wingshield, LLC, Mason, OH (US)

(72) Inventor: Paul Rush, Mason, OH (US)

(73) Assignee: Wingshield, LLC, Mason, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/489,579

(22) Filed: Sep. 29, 2021

(65) Prior Publication Data

US 2022/0018170 A1 Jan. 20, 2022

Related U.S. Application Data

(63) Continuation-in-part of application No. 16/377,397, filed on Apr. 8, 2019, now Pat. No. 11,136,813.
(Continued)

(51) Int. Cl.

| | |
|---|---|
| ***E05C 19/18*** | (2006.01) |
| ***F41H 5/013*** | (2006.01) |
| ***F41H 5/08*** | (2006.01) |
| ***F41H 5/24*** | (2006.01) |
| ***A47B 97/04*** | (2006.01) |

(Continued)

(52) U.S. Cl.
CPC ..... *E05C 19/188* (2013.01); *E05C 19/184* (2013.01); *F41H 5/013* (2013.01); *F41H 5/08* (2013.01); *F41H 5/24* (2013.01); *A47B 41/02* (2013.01); *A47B 97/04* (2013.01); *E05G 5/003* (2013.01)

(58) Field of Classification Search
CPC ..... E05C 19/00; E05C 19/184; E05C 19/188; E05C 19/003; F41H 5/013; F41H 5/06; F41H 5/08; F41H 5/24; F41H 5/00; E05B 13/00; E05B 15/00; E05G 5/003; A47B 97/04; A47B 41/02
See application file for complete search history.

(56) References Cited

U.S. PATENT DOCUMENTS 8,015,910 B1 * 9/2011 Fuqua ..... F41H 5/14 89/36.01
9,347,748 B1 * 5/2016 Crisp ..... F41H 5/08
(Continued)

*Primary Examiner* — Tan Le
(74) *Attorney, Agent, or Firm* — Stradley Ronon Stevens & Young, LLC

(57) ABSTRACT

A defense mobile device for securing a door during shelter-in-place situations. The device includes wheels rendering it mobile and stops that, when activated, hold the device stationary. A panel has a ballistic core that resists bullets, a front face, an opening, and a cover positioned over the opening to overlay and enclose a door knob protruding through the opening. The front face forms, or has affixed to it, a writing surface. The panel pivots between a plurality of angled positions to facilitate writing and an upright position flat against the door. A locking rod, rotatably connected to the panel, pushes and pulls the panel between its angled positions and its upright position. A portal defined by a ballistic door viewer or viewport is located in the panel and permits viewing or observing through the panel. A release system is configured to deactivate the stop and enable the device to move.

20 Claims, 25 Drawing Sheets

Related U.S. Application Data

(60) Provisional application No. 62/654,920, filed on Apr. 9, 2018.

(51) Int. Cl.
*A47B 41/02* (2006.01)
*E05G 5/00* (2006.01)

(56) References Cited

U.S. PATENT DOCUMENTS

| | | | | |
|---|---|---|---|---|
| 10,295,311 | B1 * | 5/2019 | Trubacek | A47B 37/00 |
| 11,136,813 | B2 * | 10/2021 | Rush | G09F 7/04 |
| 2012/0137866 | A1 * | 6/2012 | Gonard | F41H 5/026 89/36.08 |
| 2020/0025525 | A1 * | 1/2020 | Spransy | F41H 5/08 |

* cited by examiner

DEFENSE MOBILE DEVICE HAVING A RELEASE SYSTEM FOR SHELTER-IN-PLACE SITUATIONS

RELATED APPLICATIONS

This application claims the benefit of priority as a continuation-in-part of U.S. patent application Ser. No. 16/377,397, filed on Apr. 8, 2019, which in turn claims priority to U.S. Provisional Patent Application No. 62/654,920, filed on Apr. 9, 2018, and the contents of both prior applications are incorporated in this application by reference.

TECHNICAL FIELD

The present invention relates generally to the field of access and security for doors and, more particularly, to lockdown devices used to delay or deny entry by an intruder into a room with a door.

BACKGROUND OF THE INVENTION

Recent tragedies have led to a growing demand for increased safety measures in facilities such as office buildings and especially in schools. The nation was shocked by the 2012 massacre at Sandy Hook Elementary School in Newtown, Conn., where a young shooter killed 26 people—including 20 six- and seven-year-old children. More recently, on Feb. 14, 2018, a shooter entered a high school in Parkland, Fla. and began firing his assault rifle. Later, on May 18, 2018, ten people—eight students and two teachers—were fatally shot and thirteen others were wounded during a school shooting at Santa Fe High School in Santa Fe, Tex. In light of the current national concern over terrorism and mass shootings in schools and other institutional settings, a relatively standardized procedure for responding to a security threat in a school building has been developed: the "lockdown," in which teachers essentially lock themselves and their students in their rooms to deter invaders and await help. Unfortunately, the state of societal conditions now dictates that extreme security measures are not only necessary, but that it will most likely soon be mandatory for these facilities to obtain some form of security device to lock down the facility in the event of an armed intruder.

The heightened danger and frequency of intruders with deadly intent has created an urgent and immediate need to quickly and easily lock down any given door of a facility in a dangerous or life-threatening situation. In a real scenario, panic can rapidly overwhelm even frequently practiced responses—especially if much thought of what needs to be done is required. Therefore, it is essential that, in an emergency, the order for lockdown procedures be accomplished immediately, with as few steps as possible and the minimum amount of thought required, to eliminate potential delays or mistakes caused by panic, and thereby save lives. Existing products have addressed this issue, but most are prohibitively expensive for a facility on a budget, require modifications to the facility, can easily be subject to catastrophic failure at the critical time if not diligently maintained, or address confronting an intruder rather than locking the intruder out.

Many companies have tried to address the need for additional protection in schools, office buildings, and other structures. For example, LC Enterprises of Perris, Calif. (see www.lcenterprises.com), sells versatile ballistic panels and partition systems of different sizes and materials. The partitions offer interior separators that form cubicles and give office workers privacy. The company also offers trucks on which the panels fit so that the panels can be both upright and moved.

Hardwire, LLC of Pocomoke City, Md., offers a number of products designed to increase school safety. See www.hardwirellc.com. In addition to protective whiteboards that act as teaching aids and can double as a bullet-resistant shield in the event of a school shooting, Hardwire makes armored clip boards, tablets, and notebooks. It also makes hardened inserts, the size of a notebook, that can be placed in a student's backpack. Hardwire has a patent portfolio directed to its products.

U.S. Pat. Nos. 9,316,467 and 8,991,118 assigned to Hardwire, LLC disclose an armored door panel. The panel has a planar device with a layered arrangement including a protection layer comprised of a ballistic material and an outer surface layer arranged on the outer side of the protection layer. The planar device is affixed to an existing door to prevent ballistic projectiles from penetrating the door.

U.S. Pat. No. 9,090,116 assigned to Hardwire, LLC discloses an armored whiteboard device having a strike face with a dry erase markable surface that can be written on and wiped clean, and a protection layer of ballistic material attached to the strike face. The strike face and the ballistic protection layer can be used as a defensive shield to protect against oncoming ballistic projectiles. Handles on one side allow the device to be held in one position for writing upon the markable surface and in another position for protection against penetration by a projectile.

U.S. Pat. No. 8,739,675 assigned to Hardwire, LLC discloses an armor panel system with a projectile-deflecting section having an outwardly facing surface. The projectile-deflecting section is formed of a material arranged in parallel layers, the layers arranged at a non-parallel angle to the outer surface. The non-parallel angles deflect or rotate an incoming projectile.

U.S. Pat. No. 4,486,491 assigned to Dotmar Inc. of Montreal, Canada, discloses a self-supporting, decorative, armor panel having a central armor core consisting of layers of fiberglass bonded together with resin and an outer, decorative, non-ricocheting laminate on each side of the armor core. Each laminate has an outer, decorative cover layer and a plurality of paper layers bonded together with resin. In a process of making the panel, the laminates are bonded to the armor core simultaneously with the bonding together of all the layers.

Manufactured by Waco Composites of Waco, Tex. (www.armorcore.com), ArmorCore® bullet-resistant fiberglass panels provide security against bullets and blast fragments. The ArmorCore composite laminate consists of fiberglass-reinforced thermoset resin designed to defeat a projectile. All ArmorCore fiberglass panels are made of multiple layers of woven roving ballistic-grade fiberglass cloth impregnated and reinforced with a thermoset polyester resin and compressed into flat rigid sheets. Waco Composites uses a production technique and materials that provide the controlled internal delamination necessary to permit the capture of a penetrating projectile.

With reference to Underwriters Laboratory (UL LLC, the global safety consulting and certification company headquartered in Northbrook, Ill.) UL 752 Bullet Resistant Materials Standards, Waco Composites advertises its Level 1 panels as most commonly used for protection against hand guns of medium power, such as the 9 mm, Super 38 Automatic, and the like, with muzzle energy of 380-460 foot-pounds (515-624 J). Level 2 panels are most commonly used for protection against hand guns of high power, such as the 0.357 Magnum, and the like, with muzzle energy of 548-663 foot-pounds (743-899 J). Level 3 panels are most commonly used for protection against hand guns of super power, such as the .44 Magnum, and the like, with muzzle energy of 971-1,175 foot-pounds (1,317-1,593 J). Level 4 panels are most commonly used for protection against high-power hunting and sporting rifles, such as the 30-06, and the like, with muzzle energy of 2,580-3,120 foot-pounds (3,498-4,929 J). Level 5 panels are most commonly used for protection against military ball full metal copper jacket ammunition fired from a hunting rifle, such as the 308 Winchester or a military rifle with muzzle energy of 2,519-3,048 foot-pounds (3,416-4,133 J). Level 6 panels are most commonly used for protection against multiple shots from a submachine-gun, such as a 9 mm Uzi, and the like, with muzzle energy of 540-653 foot-pounds (732-885 J). Level 7 panels are most commonly used for protection against multiple shots from a military assault rifle, such as the M-16, and the like, with muzzle energy of 1,158-1,402 foot-pounds (1,570-1,901 J). Level 8 panels are most commonly used for protection against multiple shots from a military assault rifle, such as an M-14, and the like, with muzzle energy of 2,519-3,048 foot pounds (3,416-4,133 J).

Armor panels such as bulletproof glass or metal plate are known. These known panels are costly, heavy, and difficult to maneuver. Many of the known armor panels also cause bullets fired at them to ricochet. The ricocheting bullets could rebound from the panels to injure people near them. Thus, the panels do not protect as well as they should. In addition, the known panels often have an unattractive appearance, no function other than as a defensive structure, or both.

Secure Lockdown Solutions of Runnemede, N.J. advertises, through a video posted in 2016 and available at www.vimeo.com/153622483, a school lockdown table. The device is useful in the classroom only as a table. To act a safety device, the table top pivots or lifts up into position against a door using two hydraulic lifts or hinges. The table top is made from steel, which causes bullets that contact the table to shatter and create shrapnel. Because the table lacks wheels, several people are required to move the table into position and to engage the table to a door. The table only accommodates an outward-opening door; a structural change would have to be made to use the table in connection with an inward-opening door having a handle or door knob.

Several companies offer whiteboards having ballistic resistant capabilities. For example, Egan Visual Inc. of Woodbridge, Ontario, Canada offers a "Dimension Mobile" product equipped with a ballistic core. Egan advertises the product as providing multi-strike capabilities and buying precious time in an active shooter event, and asserts that the product can be specified for environments where additional "shelter-in-place" options are desired. See www.egan.com. Similarly, a subsidiary of Clifton Steel Company of Maple Heights, Ohio called Safe Place Solution markets a mobile presentation unit under the trademark WonderBoard™ that it advertises as offering frontline ballistic protection for doors and openings against active shooter threats in any environment. See www.blockbullets.com. Such products are not designed, however, to barricade a door or provide multiple layers of protection against an intruder into a room—nor do they pivot to facilitate multiple functionalities.

To overcome the shortcomings of known door safety mechanisms and lockdown devices, a new defense mobile device is provided. An object of the present device is to be used in case of a shelter-in-place or lockdown situation. A related object is to turn a room (classroom, office, or the like) into a safe room protected against intruders such as active shooters, by barricading a door with multiple layers of protection, and allow individuals or multiple persons to shelter-in-place. Another object is to protect the occupants of a room by securing doorways in all places of education, places of worship, shopping malls, government buildings, private businesses, and other structures. Another object is to provide a device that accommodates a wide variety of doors, whether they open inward into a room or outward, whatever their size (e.g., single or double doors), and regardless of their related features (e.g., a door closer, a window, and the like).

It is still another object of the present device to be "user" friendly relative to other tactical protective devices, carts, panels, or products which only law enforcement officers, military personnel, or persons with proper tactical training and capabilities can implement.

Yet another object of the present device is to provide an improved, self-supporting device having a ballistic panel which is relatively inexpensive and which can be easily maneuvered so that the panel can be used in many different structural applications. It is a further object of the present device to provide an improved ballistic panel which minimizes, or eliminates, the danger of ricochets thereby providing enhanced protection. It is a still further object of the present device to provide an improved ballistic panel which is attractive in appearance and can be used for functions other than its primary defense function. A related object is to use the device in a classroom on a daily basis as a whiteboard or video monitor.

SUMMARY OF THE DISCLOSURE

To achieve these and other objects, and in view of its purposes, provided is a defense mobile device for securing a door located in a door frame and having a door knob. The device includes a base configured to support the storage of items. A plurality of wheels are affixed to and support the base, allowing the device to be maneuvered by a user. When activated, one or more stops hold the device in a stationary position. A frame is attached to the base. At least one grip is attached to the frame and adapted to be grasped by a user to move and manipulate the device. A mechanical pivot is attached to the base. A panel has a rear face, an intermediate ballistic core, a front face, and an opening through the panel from the front face to the rear face. A cover is positioned over the opening on the rear face of the panel and configured to overlay and enclose the door knob when the door knob protrudes through the opening in the panel. The panel is connected to the base via the mechanical pivot and configured to pivot between a plurality of angled positions and an upright position flat against the door. A locking rod is rotatably connected at one of its ends to the base via a first hinge bolt and at its opposite end to the panel via a second hinge bolt, the locking rod pushing and pulling the panel between its angled positions and its upright position. One of a lever-locking mechanism or a twist-lock mechanism is configured to secure the device in place against or within the door frame and against the door. A portal defined by a ballistic door viewer or viewport is located in the panel and permits viewing or observing through the panel. A release system is configured to deactivate the stop and enable the device to move.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE DISCLOSURE

Figure 1:
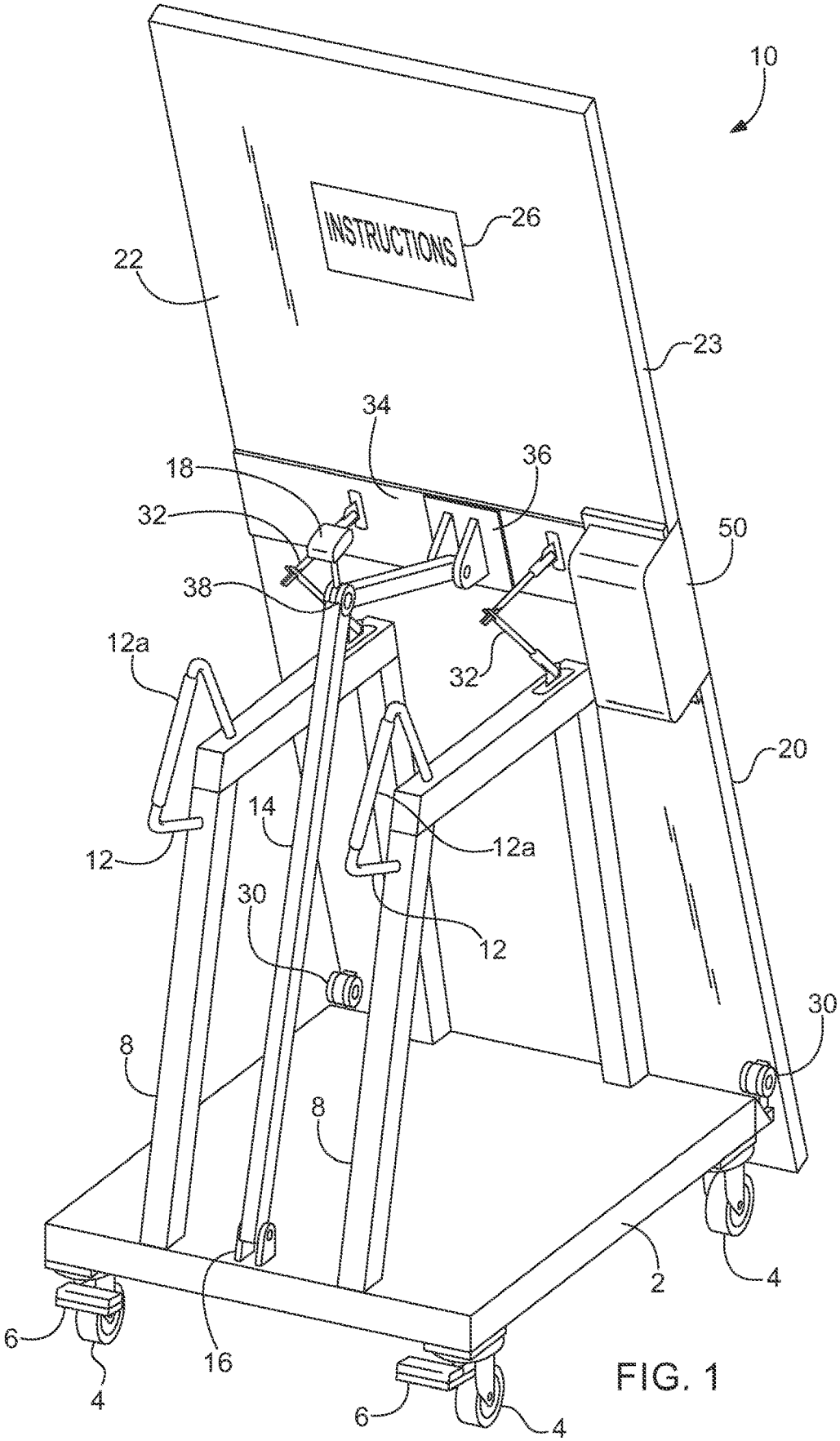
FIG. 1 is a rear, perspective view of a defense mobile device according to one embodiment.

The features and benefits of the disclosed structures, components, and devices are illustrated and described by reference to exemplary embodiments. The disclosure also includes the drawing, in which like reference numbers refer to like elements throughout the various figures that comprise the drawing. This description of exemplary embodiments is intended to be read in connection with the accompanying drawing, which is to be considered part of the entire written description. Accordingly, the disclosure expressly should not be limited to such exemplary embodiments illustrating some possible non-limiting combinations of features that may exist alone or in other combinations of features.

In the description of embodiments, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives of those terms (e.g., "horizontally," "downwardly," "upwardly," etc.) should be construed to refer to the orientation as then described or as shown in the figure under discussion. These relative terms are for convenience of description only and do not require that the apparatus be construed or operated in a particular orientation. Terms such as "attached," "affixed," "connected," "coupled," "interconnected," and similar terms refer to a relationship in which structures are secured or attached to one another either directly or indirectly through intervening structures, as well as both moveable or rigid attachments or relationships, unless expressly described otherwise.

Figure 2:
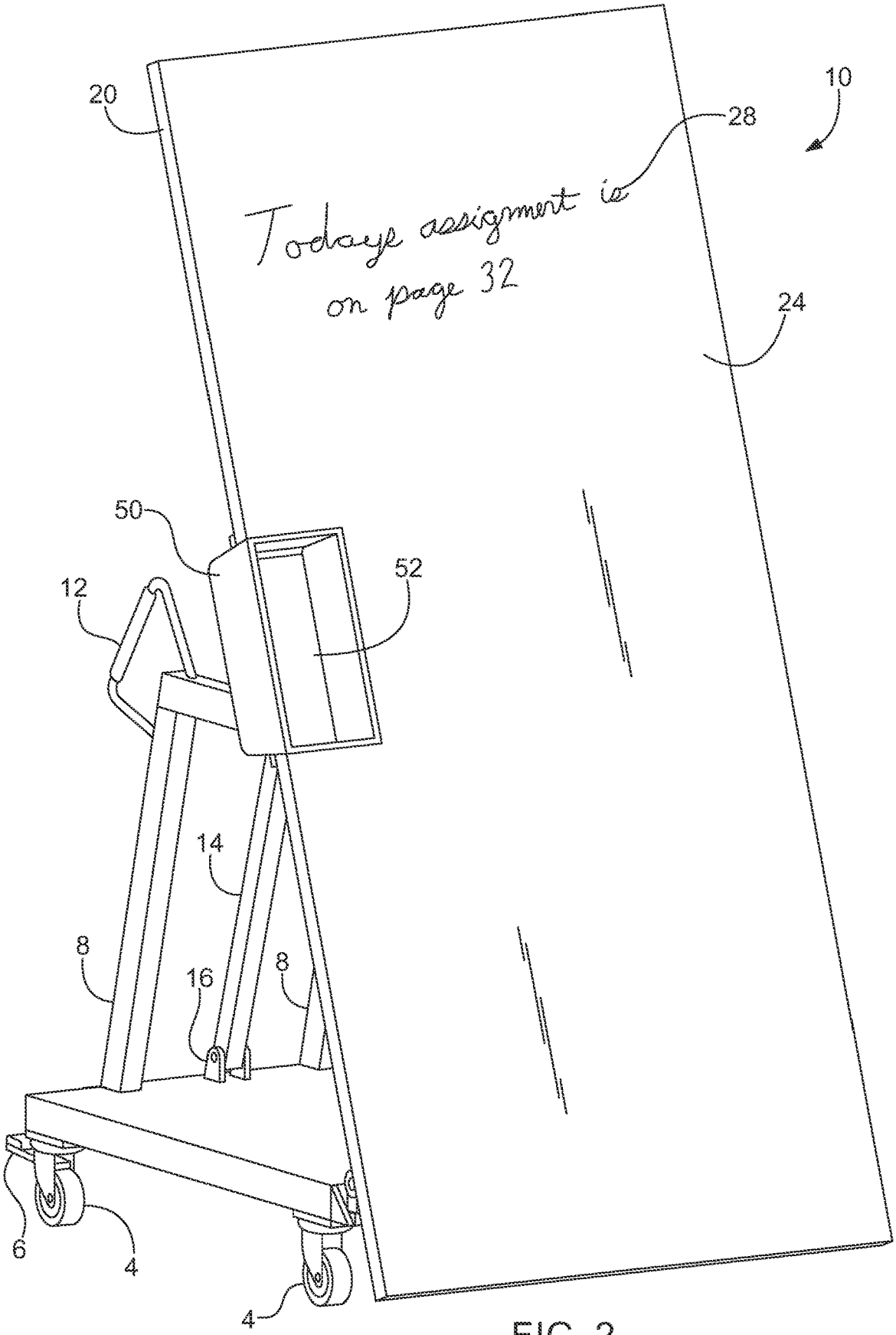
FIG. 2 is a front, perspective view of the defense mobile device shown in FIG. 1.
Figure 10:
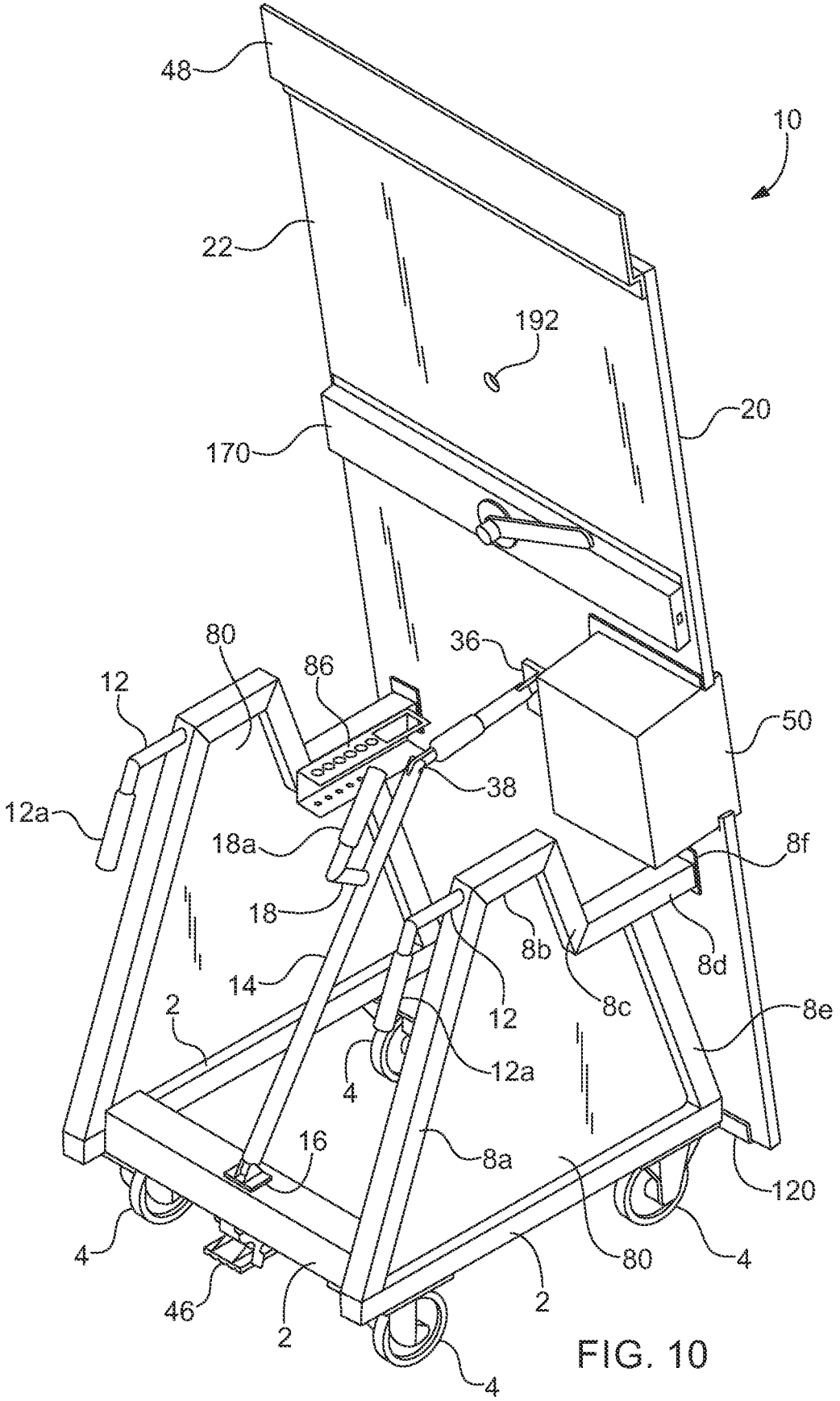
FIG. 10 is a rear, perspective view of another embodiment of the defense mobile device.

Referring now to the drawing, FIGS. 1 and 2 show a defense mobile device 10 according to one embodiment the present invention. The device 10 has a solid, substantially flat pedestal or base 2. The base 2 is typically made of metal, with steel suitable, and has sufficient strength to support the storage of other items. As illustrated in FIG. 1, the base 2 is a square-shaped, single, solid piece. Alternatively, as illustrated in FIG. 10, which is a rear, perspective view of another embodiment of the defense mobile device 10, the base 2 can be formed of four metal bars (e.g., square bars) joined together to form the shape (e.g., square) of the base 2 while leaving a center opening in the base 2. Although the base 2 can have a wide variety of shapes and sizes depending upon the application, in one example the base 2 is a rectangle with sides of 108 inches (275 cm) and 68 inches (173 cm). The base 2 extends horizontally in the X-Y plane (with a thickness in the Z-direction) of the Cartesian coordinate system illustrated in FIG. 3.

A Cartesian coordinate system (X, Y, Z) is a coordinate system that specifies each point uniquely in three-dimensional space by three Cartesian numerical coordinates, which are the signed distances to the point from three, fixed, mutually perpendicular directed lines, measured in the same unit of length. Each reference line is called a coordinate axis or just an axis of the system, and the point where they meet is its origin, usually at ordered triplet (0, 0, 0). The coordinates can also be defined as the positions of the perpendicular projections of the point onto the three axes, expressed as signed distances from the origin.

A plurality of wheels 4 are affixed to the bottom surface of the base 2. Although four wheels 4 are illustrated in FIGS. 1-5, other numbers of wheels 4 could be used. The wheels 4 support the base 2 and allow the device 10 to be maneuvered easily (specifically, rolled) by a user. The size and type of the wheels 4 can be predetermined to accommodate both a particular application (i.e., structural setting) in which the device 10 will be used and the size and weight of the base 2 and other components supported on the base 2 (i.e., wider and heavier components might require more wheels 4). By "predetermined" is meant determined beforehand, so that the predetermined characteristic (e.g., the size and type of the wheels 4) must be determined, i.e., chosen or at least known, in advance of some event (such as the manufacture of the particular embodiment of the device 10).

Relatively large (e.g., 1 inch (2.5 cm) diameter and 1 inch (2.5 cm) wide) caster wheels will roll over almost anything in an office or classroom, including rugs and carpets, without skidding. Caster wheels have ball bearing swivels for 360° rotation, enhancing the maneuverability of the device 10. Therefore, relatively large caster wheels are suitable for the wheels 4 of the device 10. The specific set of wheels 4 affixed to the bottom surface of the base 2 may include different wheels: two fixed wheels 4 may be affixed to the front of the base 2, for example, while two caster (swivel) wheels 4 are affixed to the rear of the base 2.

Suitable materials for construction of the wheels 4 are plastic; rubber; steel, aluminum, or other metals; tire tread; and combinations of such materials. A preferred material for the wheels 4 is polyurethane, which is a polymer composed of organic units joined by carbamate (urethane) links. Polyurethane is a true elastomer capable of tremendous impact resistance even at very high durometers. More important, polyurethane retains it elasticity and strength over the complete range of hardness.

One or more pedal stops 6, stops 46, or both pedal stops 6 and stops 46 are provided on the device 10 to hold the device 10 in a stationary position, and prevent moving or maneuvering the device 10, when desired. The pedal stop 6 is activated when a user presses downward on the pedal stop 6, typically using a foot, and released when the user again presses downward on the pedal stop 6 to toggle the pedal stop 6 into its released position. As shown in FIG. 1, the pedal stops 6 are affixed directly to the wheels 4 such that, when activated, the pedal stops 6 directly contact the wheels 4 and prevent the wheels 4 from rotating. Alternatively or in addition, as shown in both FIG. 4 and FIG. 6, one or more stops 46 (akin to door stops) may be affixed to the base 2 at a location or locations removed from the wheels 4 such that, when activated, the one or more stops 46 contact the floor 100 or other structure on which the wheels 4 otherwise roll and prevent the wheels 4 from rolling.

The base 2 supports a vertical frame 8. The frame 8 may be attached to the base 2, for example, by welding the frame 8 to the base 2. Alternatively, the frame 8 may be integral with the base 2. By "integral" is meant a single piece or a single unitary part that is complete by itself without additional pieces, i.e., the part is of one monolithic piece formed as a unit with another part. In the embodiment shown in FIG. 1, the frame 8 includes two, identical A-shaped struts in the shape of an isosceles trapezoid extending upward from the base 2 in the "Z" direction. The frame 8 is typically, although not necessarily, formed of a strong metal such as steel. A heavy-duty 1 inch by 1 inch (2.5 cm by 2.5 cm) rectangular steel tubing about 0.063 inches (0.16 cm) thick is suitable for the frame 8.

In another embodiment, shown in FIG. 10, the frame 8 includes two, mirror-image sides extending upward from the base 2 in the "Z" direction. Each side includes a first angled strut 8*a* extending upward from the rear of the base 2, a horizontal connector 8*b*, a second angled strut 8*c*, a horizontal head 8*d*, and a third angled strut 8*e* extending upward from the front of the base 2. The horizontal head 8*d* may extend (as illustrated in FIG. 10, although such extension is not required) beyond the juncture between the horizontal head 8*d* and the third angled strut 8*e*. A bearing plate 8*f* is attached to the end of the horizontal head 8*d*. The horizontal connector 8*b*, the second angled strut 8*c*, and the horizontal head 8*d* combine to form a "Z"-shaped cutout in the frame 8 which accommodates interaction between the frame 8 and other components (as described below).

Other embodiments of the frame 8 are also envisioned. For example, the frame 8 might include one side formed of the A-shaped strut shown in FIG. 1 and other side formed of the angled side shown in FIG. 10. The sides of the frame 8 also might have other shapes, such as rectangular or square.

Figure 12:
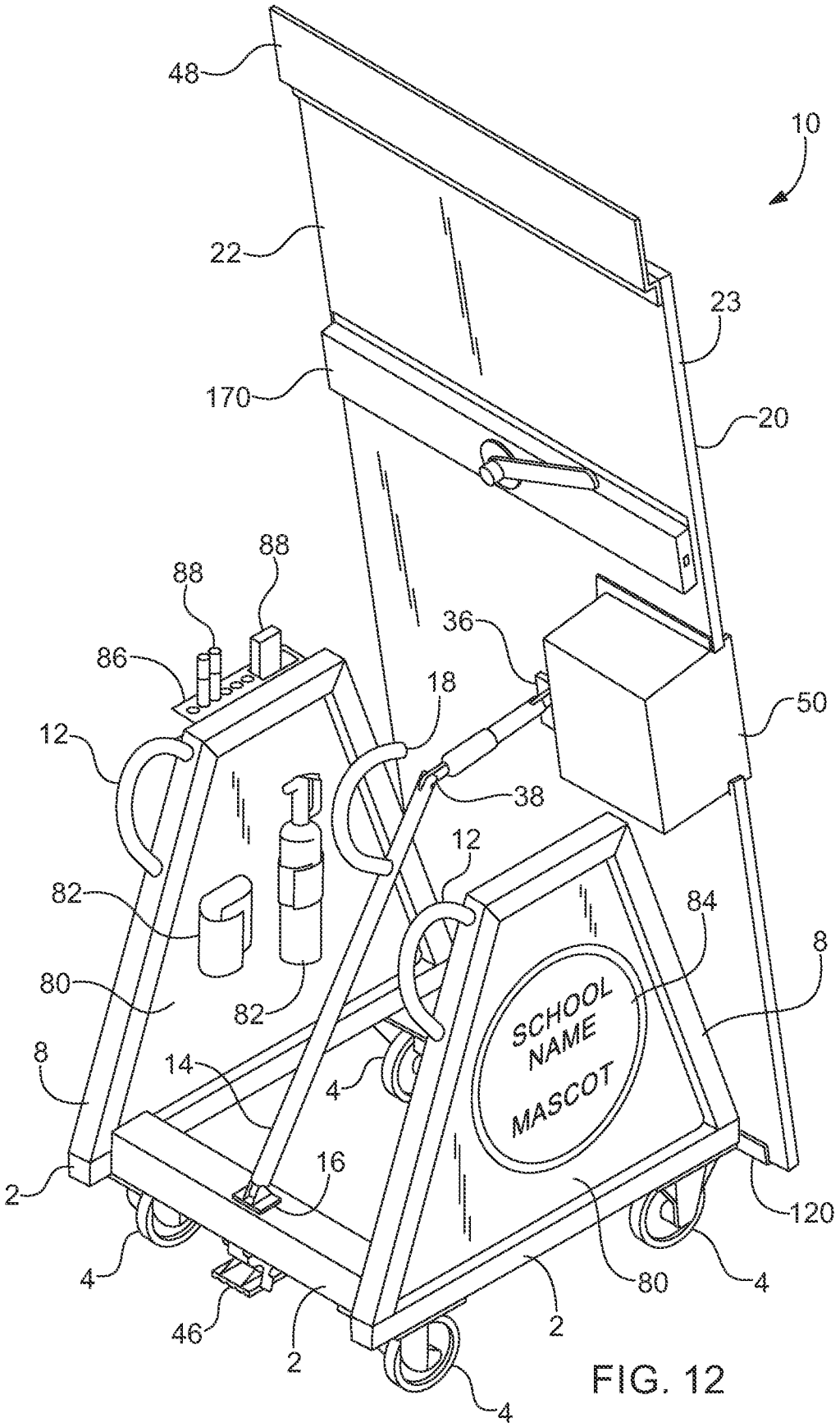
FIG. 12 is a rear, perspective view of yet another embodiment of the defense mobile device including accessories, stored items, printed information, and grips and a handle having alternative shapes.

A steel plate or upright 80 (see FIG. 10) can be affixed (e.g., welded or fastened) to the frame 8 on one or both sides of the frame 8. The upright 80 can have any suitable thickness, such as about 3/16 inches (0.5 cm) thick, and can be made of any suitable material (although steel is preferred). The upright 80 follows the shape of the frame 8 and functions to enclose the area between the two sides that form the frame 8. That area can then offer enhanced protection for items 82 to be stored in the area between the frame 8 and on top of the base 2. Stored items 82 can include, for example and as illustrated in FIG. 12, recommended lifesaving and defensive items such as a trauma kit, a gun safe, mace, a tactical flashlight, and a fire extinguisher. (FIG. 12 is a rear, perspective view of yet another embodiment of the defense mobile device 10.) The stored items 82 can be affixed directly to the frame 8, such as via Velcro® fasteners or straps, or can be stored in pouches or containers that are affixed to the frame 8.

Velcro® is the brand name of the first commercially marketed fabric hook-and-loop fastener sold by Velcro USA, Inc. of Manchester, N.H. The fastener was invented by George de Mestral. See U.S. Pat. No. 3,009,235. Hook-and-loop fasteners consist of two components: typically, two lineal fabric strips or tapes (alternately round dots or squares) which are attached (e.g., sewn, adhered, etc.) to the opposing surfaces to be fastened. The first component features tiny hooks (e.g., the hook tape); the second features even smaller and "hairier" loops (e.g., the loop tape). When the two surfaces are pressed together, the hooks catch in the loops—and the two pieces fasten or bind temporarily. When separated, by pulling or peeling the two surfaces apart, the Velcro® strips make a distinctive "ripping" sound.

The upright 80 also provides the opportunity to include printed information 84 on the frame 8. As shown in FIG. 12, the printed information 84 can present a variety of concepts such as a school name or mascot, a slogan or logo, instructions, a message, a design, colors, and the like. The printed information 84 may be affixed to the upright 80, via a magnet for example, or printed directly in or on the upright 80.

One or a pair of grips 12 are provided on one or both sides of the frame 8. The grips 12 are adapted to be grasped by a user and enable the user to maneuver, control, drive, steer, push, operate, and manipulate easily the device 10. The grips 12 are typically affixed to the frame 8, for example, by welding.

A locking rod 14 is rotatably connected at one of its ends to the base 2 of the device 10 via a first hinge bolt 16. The first hinge bolt 16 is typically affixed to the base 2, for example, by welding. A handle 18 of the locking rod 14 may be located at an elbow 38 (FIG. 1) or elsewhere (FIG. 10) of the locking rod 14. A user can manually operate the handle 18 to manipulate the locking rod 14. Alternatively, the handle 18 can be designed to engage automatically and to be released by remote signal.

Although ergonomic designs for the grips 12 and the handle 18 are preferred, the grips 12 and the handle 18 may have a variety of configurations. The figures illustrate just some of the possible configurations. FIG. 1 illustrates U-shaped grips 12 and a palm-shaped handle 18. FIG. 10 illustrates both the grips 12 and the handle 18 having a L-shaped configuration. FIG. 12 illustrates both the grips 12 and the handle 18 having a C-shaped configuration.

Typically, although not necessarily, one or more of the grips 12 and the handle 18 have handholds 12*a* and 18*a*, respectively, to facilitate engagement by the user. The handholds 12*a* and 18*a* are made of a material comfortable to grasping by users, such as rubber, plastic, or foam or a combination of such materials. The handholds 12*a* and 18*a* may be, for example, from 1 inch (2.5 cm) in length to 20 inches (50 cm) in length.

A tray 86 can be affixed to the frame 8 to store a wide variety of accessories 88. The tray 86 can be affixed to any suitable location on the frame 8, including inside the frame 8 (see FIG. 10) or outside the frame 8 (see FIG. 11). The tray 86 may be made of any suitable material, including plastic, aluminum, and the like. The accessories 88 may include writing implements such as pens, pencils, and dry-erase markers; a remote control or computer mouse; and other conventional items. Dry-erase markers offer high quality writing performance and, as their name implies, can be dry-erased using an eraser or cloth (which constitute additional accessories 88). Such accessories 88 as the markers, eraser, and cloth are commercially available from a plethora of sources including, for example, Egan Visual, Inc. of Canada (www.egan.com).

Figure 3:
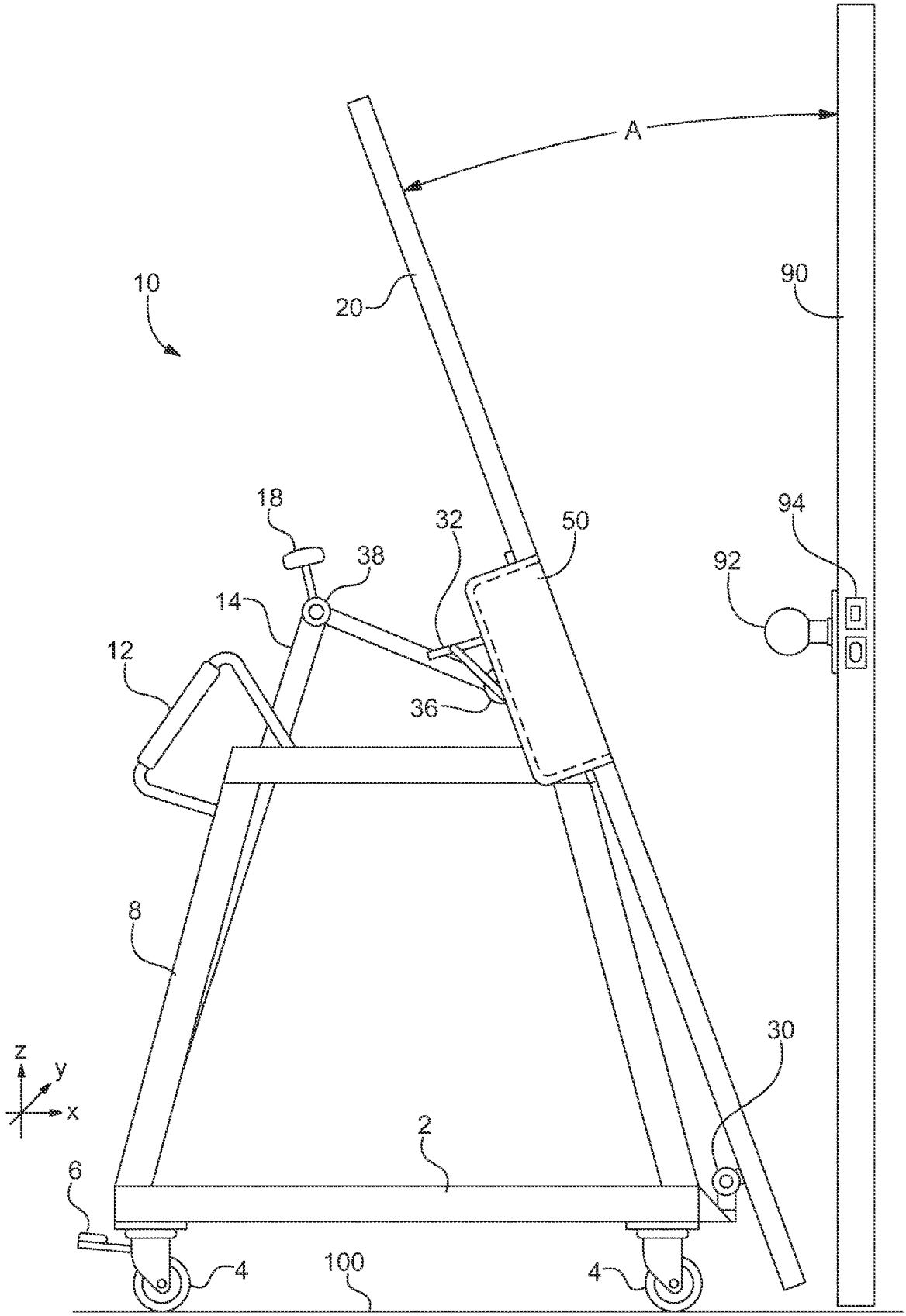
FIG. 3 is a side view of the defense mobile device shown in FIGS. 1 and 2 as the device is placed into position to engage a door.
Figure 4:
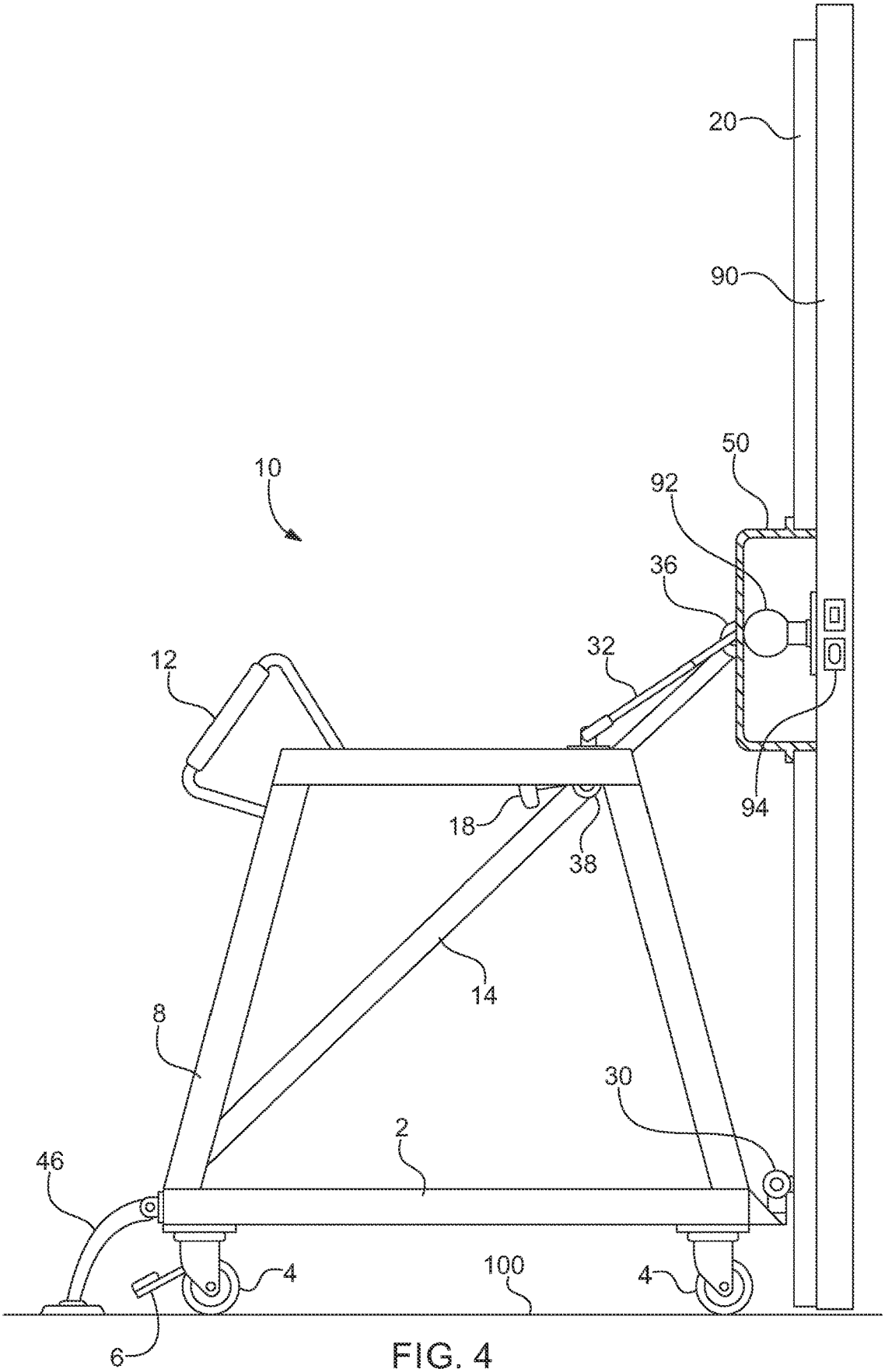
FIG. 4 is a side view of the defense mobile device shown in FIGS. 1 and 2 with the device engaging a door.
Figure 5:
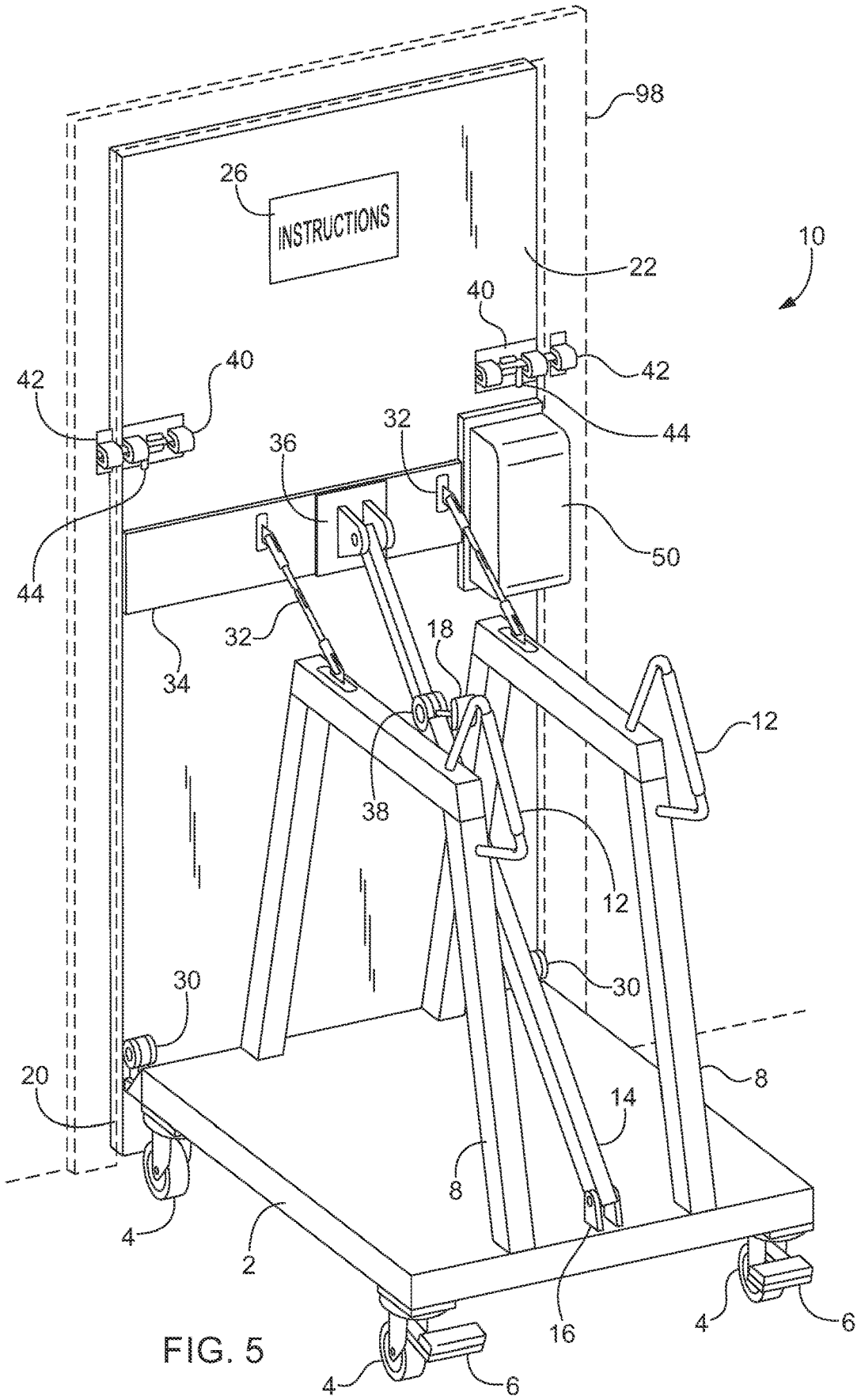
FIG. 5 is a rear view of the defense mobile device shown in FIGS. 1 and 2 with the device engaging a door.

The device 10 also has a ballistic panel 20 with a rear face 22, a side edge 23, and a front face 24. The end of the locking rod 14 opposite the base 2 is rotatably connected to the panel 20 via a second hinge bolt 36. In some embodiments, for example the embodiment illustrated in FIG. 10, the bearing plate 8*f* of the horizontal head 8*d* may contact and thereby support the panel 20 when the panel 20 leans backward. The second hinge bolt 36 is either affixed to or integral with the panel 20. The panel 20 is connected to the base 2 of the device 10 at one or more mechanical pivots 30. When the handle 18 is operated to manipulate the locking rod 14, the panel 20 can assume a large number of different positions with respect to the base 2 and the frame 8: angled as shown in FIGS. 1, 2, and 3, or vertical (perpendicular to the X-Y plane and in the Z direction) as shown in FIGS. 4 and 5. Thus, the panel 20 can move back and forth in the direction of arrow "A" shown in FIG. 3. Once the panel 20 is in a desired position, the panel 20 can be locked in that position by operating the handle 18.

A set of instructions 26 are affixed (e.g., adhered) to the rear face 22, advising the user about correct operation of the device 10. The front face 24 of the panel 20 forms a writing surface such as an acrylic surface, a chalkboard, a whiteboard, or the like on which a user can write a message 28. A whiteboard (also known by the terms marker board, dry-erase board, wipe board, dry-wipe board, pen-board, and grease board) is a flat surface having a high smoothness or glossiness that can be written upon or otherwise marked using a non-permanent marker and then wiped clean. Whiteboards are commonly made of six types of materials: (1) melamine is a resin-infused paper that is typically used over a substrate that can range from particle board to medium density fiberboard; (2) painted steel or aluminum; (3) hard-coat laminate; (4) porcelain or enamel-on-steel; (5) tempered glass; and (6) polypropylene film. Whiteboards have become ubiquitous in classrooms, offices, and other institutions and, therefore, are preferred as the front face 24 of the panel 20.

Figure 13:
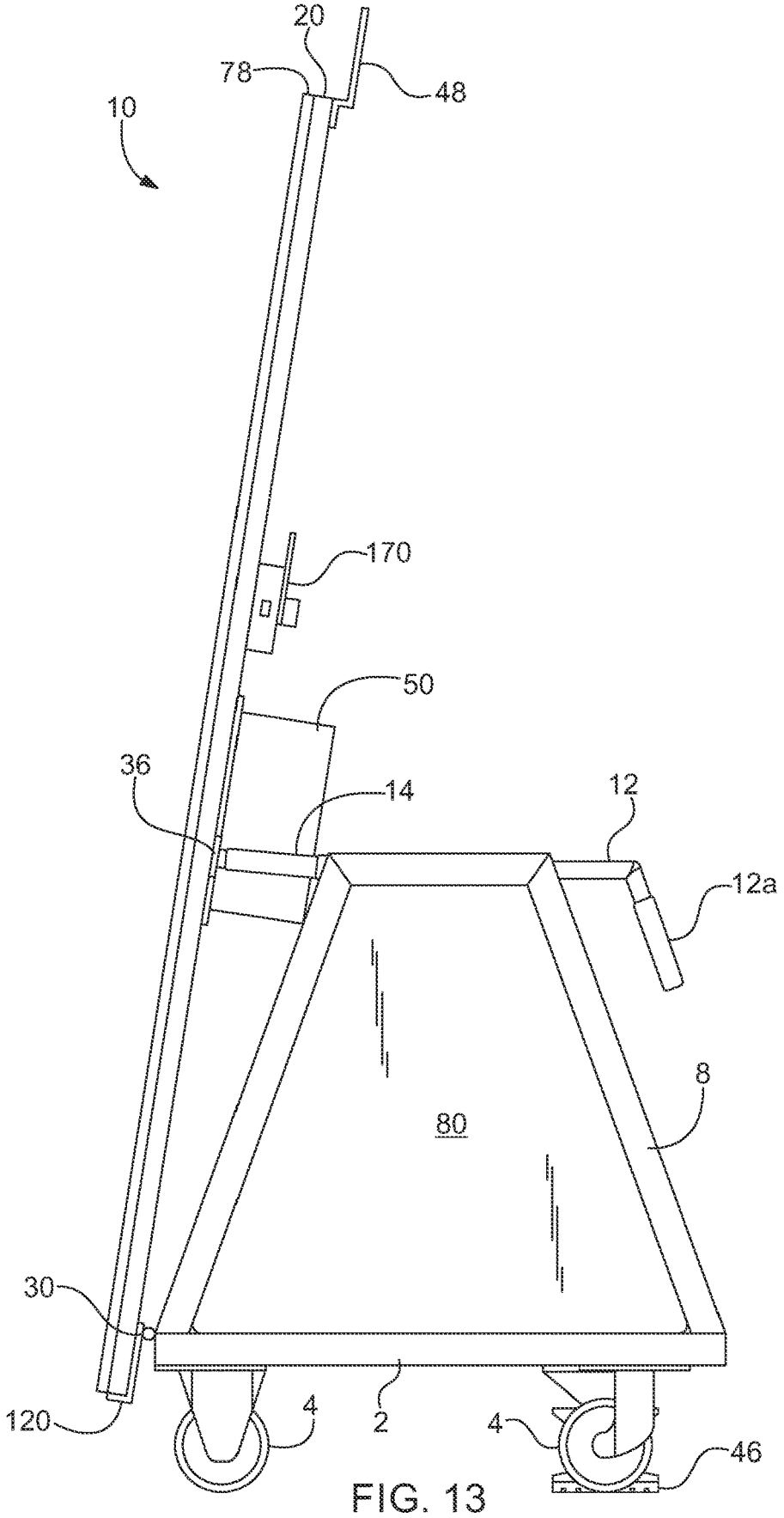
FIG. 13 is a side view of a further embodiment of the defense mobile device illustrating a separate whiteboard.

The whiteboard may be integral with the front face 24 of the panel 20. Alternatively, the whiteboard may be a separate component that is placed over the front face 24. (Alternatively, other components such as cork boards, tack boards, and the like could be placed over the front face 24 if desired for a particular application.) A separate whiteboard 78 is illustrated in FIG. 13, which is a side view of a further embodiment of the defense mobile device 10. The whiteboard 78 can cover all, or only a desired portion, of the front face 24 of the panel 20. The whiteboard 78 can be affixed to the front face 24 using a variety of fasteners such as screws, nails, tacks, rivets, and the like, as would be appreciated by an artisan. The front face 24 of the panel 20 may have a plurality of anchoring plugs (typically plastic or metal) to receive the fasteners and act as fastener inserts. A corresponding number of fasteners would be used to affix the whiteboard 78 to the front face 24. Nine fasteners and plugs are suitable, but more or fewer fastener-and-plug combinations are possible.

The configuration illustrated in FIG. 13 of a separate whiteboard 78 allows the whiteboard 78 to be replaced easily if the whiteboard 78 becomes damaged or obsolete. To render replacement of the whiteboard 78 even easier, the fasteners can be replaced by an "L"-shaped bracket (not shown) affixed to the front face 24 and used to support the whiteboard 78. The bracket allows the whiteboard 78 to slide into position over the panel 20 and against the front face 24. The user can simply slide a damaged or obsolete whiteboard 78 out of its position against the front face 24 and slide a new whiteboard 78 into position when needed. Rather than fasteners, a relatively permanent adhesive, such as glue, could be used to affix the whiteboard 78 to the front face 24 especially if replacement of the whiteboard 78 is not anticipated.

Figure 14A:
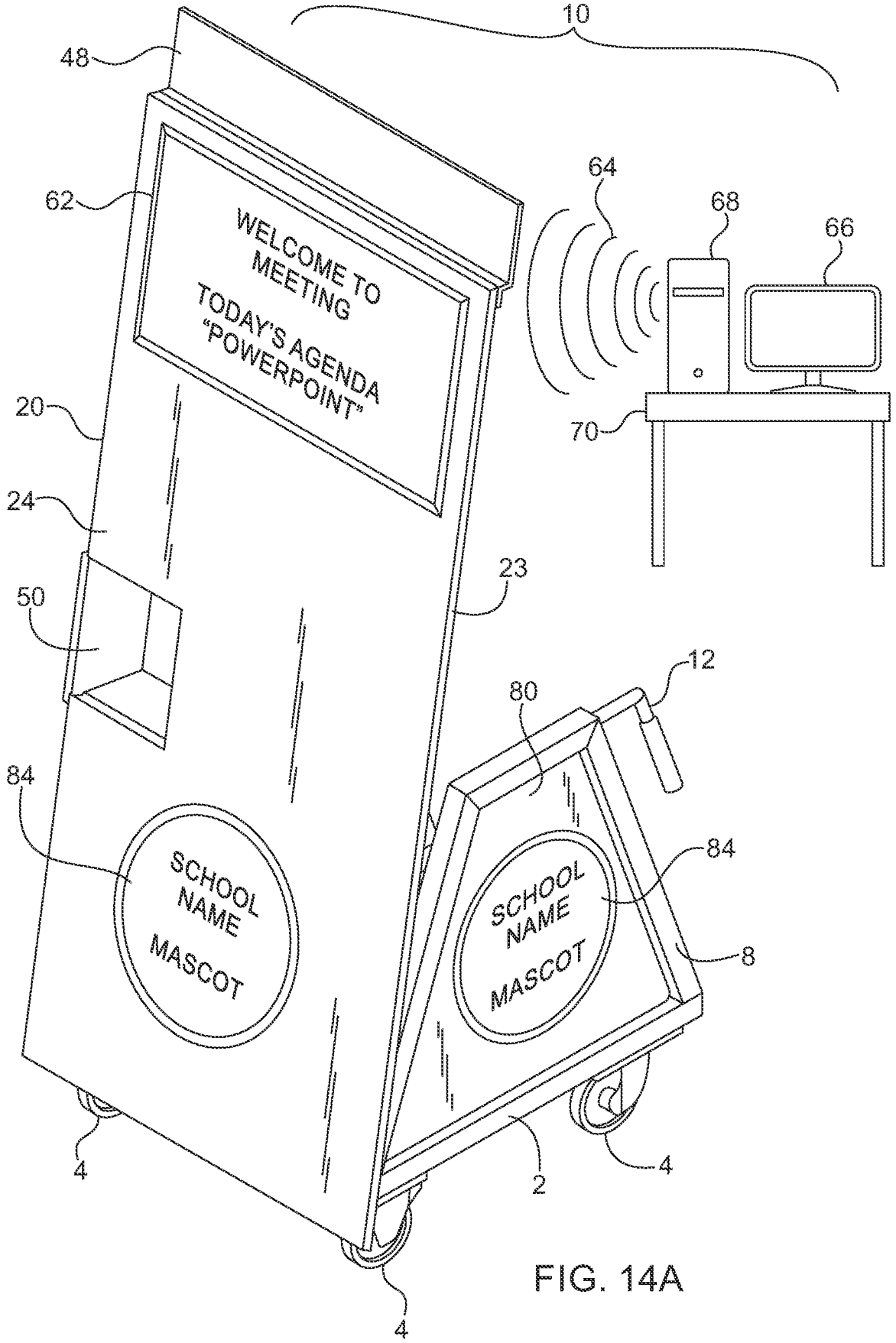
FIG. 14A is a front, perspective view of an additional embodiment of the defense mobile device including a display, transceiver, and controller.
Figure 14B:
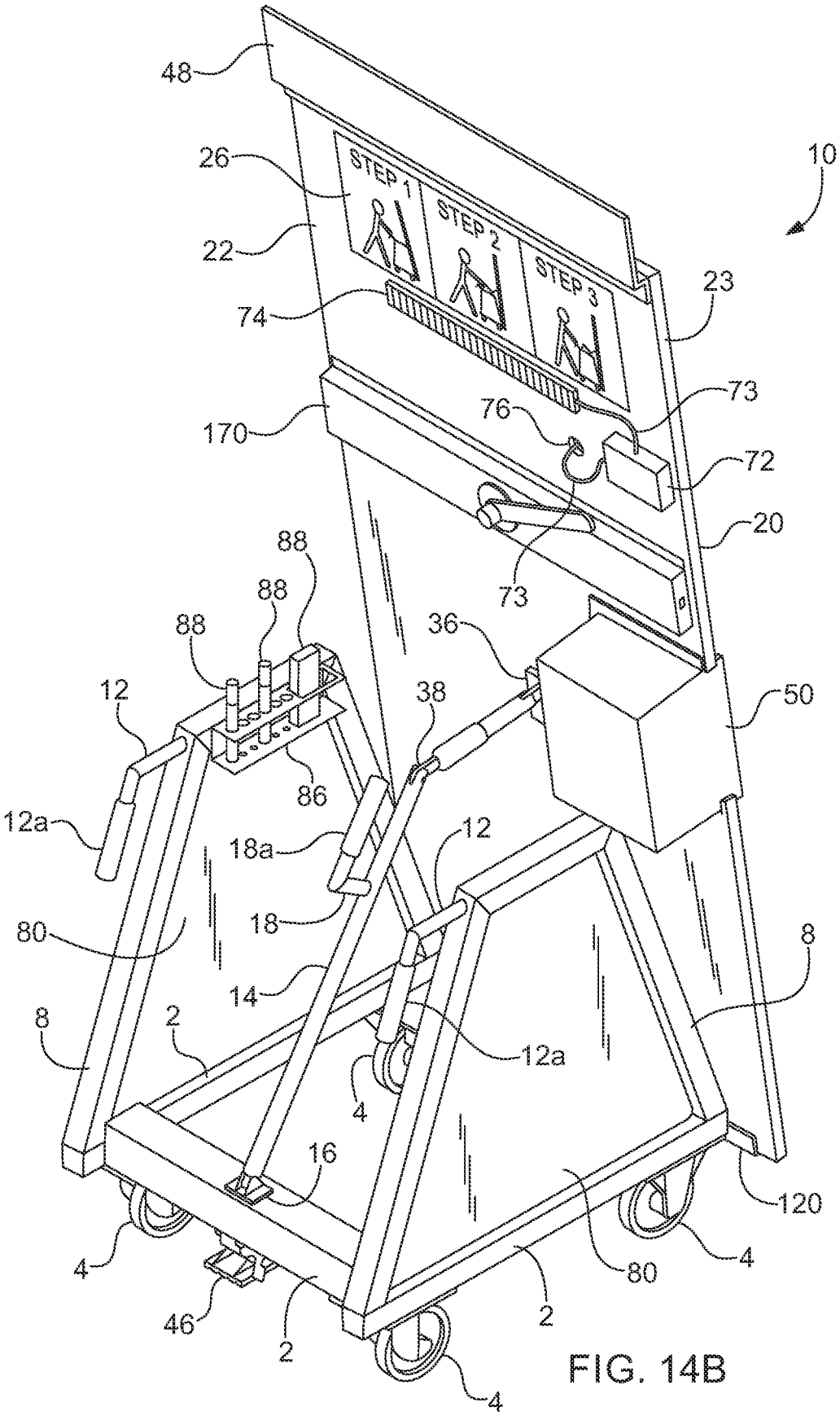
FIG. 14B is a rear, perspective view of the defense mobile device shown in FIG. 14A illustrating a power pack, an audio sound board, and associated wires at least one of which engages the display.

Other components useful for the normal operation of a classroom or workplace can also be combined with the device 10. Some of those components are illustrated in FIGS. 14A and 14B, which are front and rear perspective views, respectively, of another embodiment of the device 10. As shown in FIG. 14A, which is a front, perspective view of an additional embodiment of the defense mobile device 10, a LED/LCD or television screen, monitor, computer monitor, touch pad device, touch screen-stylist pen smart board technology (available from Microsoft Corporation of Redmond, Wash.), or the like (each a display 62) is provided on the front face 24 of the panel 20. A user can interact with the display 62 in many ways, including viewing the display 62, moving the location of the device 10 and thereby the display 62, and changing the information that appears on the display 62. Such information might be, for example, learning videos, PowerPoint presentations, and other audio and visual information.

A controller is a hardware device or a software program that manages or directs the flow of data (i.e., facilitates communication 64, perhaps through a transceiver 68) between two components. The device 10 can include a controller 66. The controller 66 provides the ability to obtain data from, for example, the display 62, the grips 12, the handle 18, the locking rod 14, the lever-locking mechanism, the wheels 4, the pedal stop 6, and the panel 20, and to use that data to control the other components of the device 10. The controller 66 has programmed in it, in a manner well-known to those skilled in the art, a preset control program or routine to assure efficiently the operation of the various components of the device 10. More specifically, the controller 66 can, for example, define the information that appears on the display 62, identify when the grips 12 of the handle 18 are touched, cause the wheels 4 to move, activate the pedal stop 6, and position the panel 20. A hand-held joystick (not shown) could interact through the controller 66 to fully control and steer the device 10 to a doorway and into place against a door or doorway for sheltering-in-place without human physical interaction. This concept would keep an occupant of the room in which the device 10 is located away from the largest threat in the room, which is the doorway and its related door. The controller 66 helps to assure a robust and reproducible automated operation of the device 10. The controller 66 and transceiver 68 can be positioned on any suitable surface, such as a table 70.

As shown in FIG. 14B, which is a rear, perspective view of the defense mobile device 10 shown in FIG. 14A, the device 10 can accommodate still additional components peripheral to its main functions of defense and safety. Provided on the rear face 22 of the panel 20 are a power pack or battery 72, an audio sound board 74, and associated wires 73. At least one of the wires 73 may engage the display 62 on the front face 24 of the panel 20 through a hole 76 in the panel 20. Thus, the device 10 can be provided with electric power. The electric power can be used to operate the components of the device 10 already discussed and illustrated, as well as additional components not illustrated (such as, for example, a powered "panic button").

As discussed above, the device 10 provides the practical features of an angled whiteboard, the storage of items, and interactive communications in addition to its main functions of defense and safety. The device 10 can be used daily as a whiteboard with erasable markers. When not used for its main purpose of securing a doorway, the device 10 provides a front face 24 that rests back on an angle to function as a typical whiteboard for use in classrooms and offices. This function advantageously avoids both a "fortress" look that risks making some individuals uncomfortable and occupation of limited space in the classroom or office with a defense and safety device that, hopefully, would never be needed.

The main structure of the panel 20, however, is a ballistic core. A suitable core for the panel 20 is available from Waco Composites of Waco, Tex. See www.armorcore.com. Another suitable core for the panel 20 is available from ArmorCo of Ashtabula, Ohio. See www.armorco.com. ArmorCo is one of the leading suppliers of Kevlar bullet-resistant fabrics and fiberglass bullet-resistant panels in the United States. (Kevlar is a registered trademark of E.I. duPont de Nemours & Co., Inc. of Wilmington, Del. used in connection with a synthetic fiber.) A suitable ArmorCo core for the panel 20 is made utilizing multiple layers of specially woven fiberglass with a proprietary resin system. The core may be considered fiberglass opaque armor. The core for the panel 20 stops bullets by capturing the ballistic projectiles in an innovative process called ply-delamination, and also defeats the projectiles without the danger of ricocheting or spalling. Bullets and other projectiles are not deflected by the panel 20. Thus, the panel 20 catches the bullet or projectile and prevents a threat to other individuals or innocent bystanders. The panel 20 preferably has a UL 752 rating of Level 7 or higher. The panel 20 may have a different UL 752 rating, however, such as Level 5, Level 8, or other Levels, depending upon the application.

Ballistic resistance tests were performed on the panel 20 having the ArmorCo core by H.P. White Laboratory, Inc. of Maryland. All testing was conducted on an indoor range at ambient conditions, in accordance with modified provisions of UL-752. Testing was conducted using caliber 5.56×45 mm, 55 gr.; 12 ga, SLUG; and 9 mm, 124 gr., full metal jacket (FMJ) ammunition. The test samples were positioned 15 feet (4.5 m) from the muzzle of the barrel to produce zero degree obliquity impacts. Photoelectric infrared screens were located at 5 feet (1.5 m) and 10 feet (3 m) which, in conjunction with electronic chronographs, were used to compute bullet velocities at 7.5 feet (2.3 m) forward of the muzzle. Penetrations were determined by visual examination of the ⅛ inch (0.32 cm) thick corrugated cardboard witness plate, placed 15 inches (38 cm) behind and parallel to the test samples.

Tests were conducted both with a classroom door closed and the panel 20 in position behind the door and with the door open (so that bullets hit the panel 20 directly). Bullets were directed at various components of the device 10, including the cover 50 (see below) and the locking rod 14. In all cases where the door was closed, the bullets penetrated through the door. In none of the tests, whether the door was open or closed and regardless of where the bullets were directed, did the bullets penetrate through the panel 20. Tests were also done using a battering ram to try to disengage the panel 20 from its position against the door or door frame; in none of those tests was the panel 20 breached.

Figure 15:
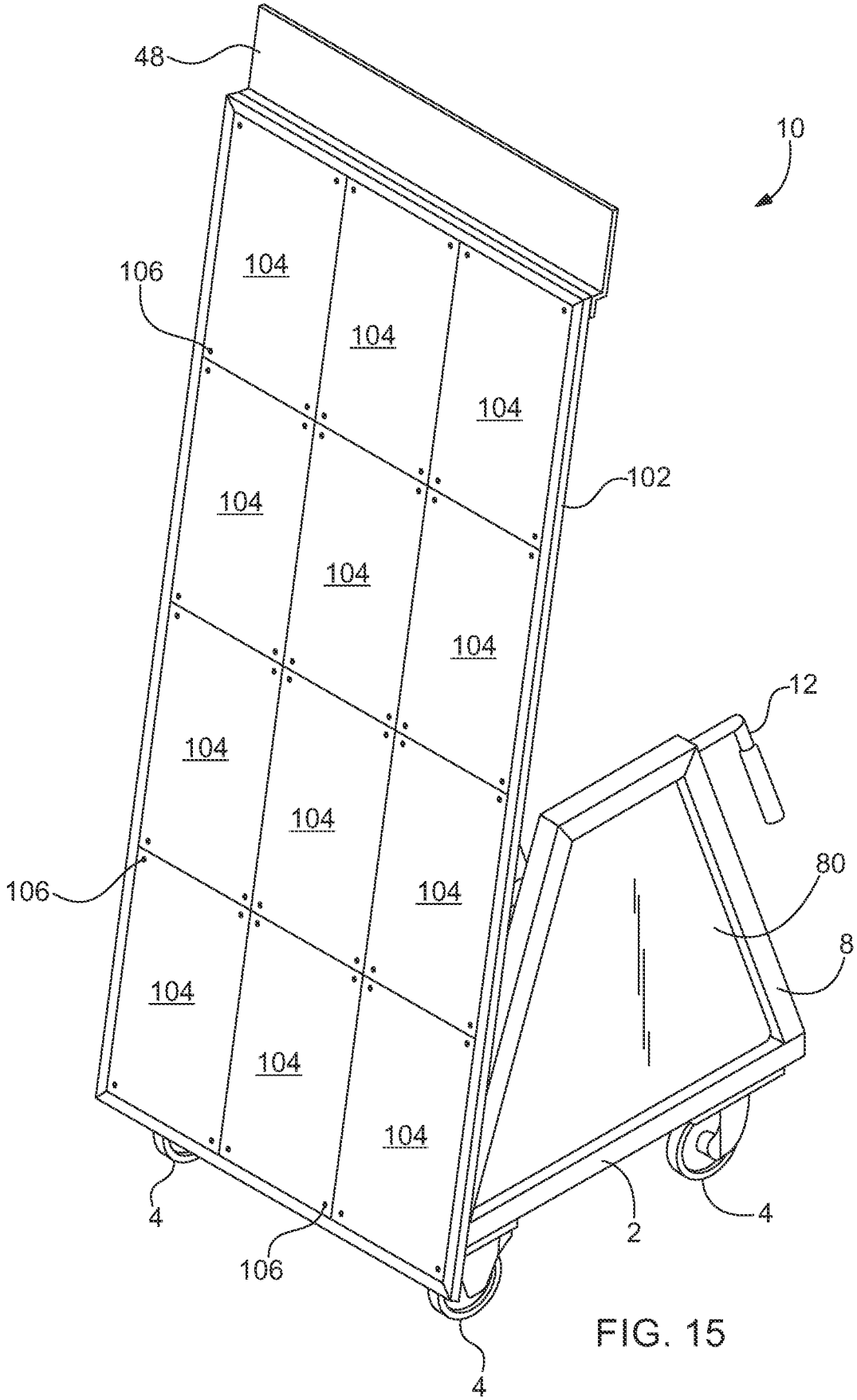
FIG. 15 is a front, perspective view of a first alternative embodiment of the ballistic core of the panel of the defense mobile device including a steel plate with a plurality of ballistic control rubber blocks attached to and covering the steel plate.

At least two other alternatives are envisioned for the ballistic core of the panel 20. The first alternative is illustrated in FIG. 15 The ballistic core in this first alternative includes a rectangular steel plate 102 with one or more ballistic control rubber blocks 104 attached to and covering the steel plate 102. One rubber block 104 may cover the entire surface of the steel plate 102. Any suitable number of rubber blocks 104 may be provided, however, and twelve such rubber blocks 104 are illustrated in FIG. 15. Regardless of their number, the rubber blocks 104 can be attached to the steel plate 102 in any suitable manner such as with pins, screws, spikes, or other fasteners 106 or with an adhesive. A suitable thickness for the rubber blocks 104 is 2 inches (5 cm).

Ballistic rubber is often used to prevent escapes and ricochets of bullets and bullet fragments in gun-training ranges. Although ballistic rubber can stop some rounds, depending on the thickness of the ballistic rubber, bullets can usually penetrate the ballistic rubber. The ballistic rubber typically allows the bullets to pass through it and then strike a hard surface such as the steel plate 102. Upon contact with the steel plate 102, the bullets lose both energy and their original shape and safely either come to rest between the ballistic rubber and the steel plate 102 or become embedded in the ballistic rubber. Thus, the rubber blocks 104 contain bullets and fragments and prevent shrapnel from ricocheting. Several companies manufacture and sell products suitable as the ballistic rubber blocks 104. Range Systems, Inc. of New Hope, Minn. offers ballistic rubber products under the trademarks Dura-Bloc™ and DuraPanel™. See U.S. Pat. No. 5,316,708, incorporated in this application by reference. Cumberland Rubber Supply of Nashville, Tenn., and Black Iron Rubber Company of Babbitt, Minn., also offer suitable ballistic control rubber products.

Figure 16:
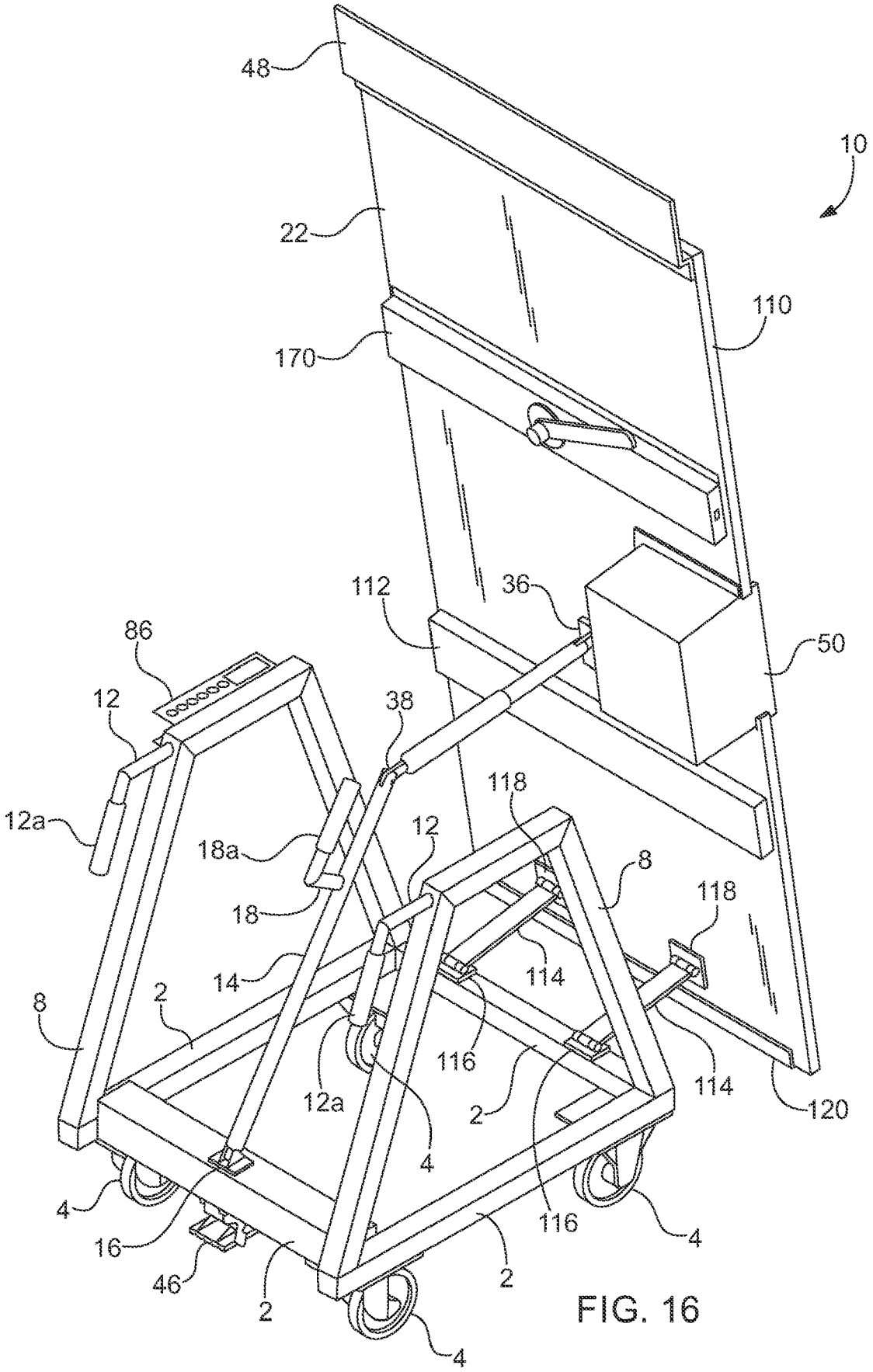
FIG. 16 is a rear, perspective view of a second alternative embodiment of the ballistic core of the panel of the defense mobile device including a single steel sheet.

The second alternative is illustrated in FIG. 16. The ballistic core in this second alternative for the panel 20 includes a single steel sheet 110. The steel sheet 110 is preferably abrasion-resistant ("AR") steel. AR500 is a hardened, tempered, high-carbon alloy steel that is commonly used for targets and armored applications; AR500 is ideal for high-wear applications. With a high Brinell hardness number (BHN), AR500 steel is perfect for targets because of its functionality and safety. By providing impact resistance, bullets are more likely to hit a flat surface on the target and follow usual ricochet patterns. When softer steels are used and deformations occur, there is a much higher possibility for an unusual bounce back that could cause injury. This second alternative does not stop ricochets, however, or contain bullets.

AR500 steel sheet having a thickness of ⅜ inches (0.95 cm) weighs approximately 15.3 pounds per square foot. To accommodate the weight of the steel sheet 110, several components can be added to the device 10. A counterweight 112, typically also made of steel, can be added to (placed on) the rear face 22 of the panel 20 to achieve proper weight distribution. The weight of counterweight 112 will depend, of course, on the application but a weight of 90 pounds (40.8 kg) has been found suitable in some applications. One or more (two are illustrated) arms 114 can be added to connect and support the steel sheet 110. The arms 114 can be made of flat steel attached to the base 2 using pin hinges 116 and to the rear face 22 using brackets 118. A band 120 can be added at or near the bottom of the rear face 22 for increased support of the steel sheet 110. The band 120 can be a flat piece attached only to the rear face 22 or the band 120 can be an "L"-shaped piece attached to both the rear face 22 and the bottom of the panel 20.

Regardless of the alternative used to form the ballistic core of the panel 20, the whiteboard 78 may be attached to it. Also regardless of the alternative used to form the ballistic core of the panel 20, a standard size for the panel 20 is 4 feet (122 cm) in width, 8 feet (244 cm) in height, and 1 inch (2.5 cm) in thickness. Other sizes of panel 20 can be made if needed, however, to accommodate the doors of existing buildings. The device 10 is designed (e.g., sized) so that once it is assembled inside of a classroom or office, the device 10 cannot be wheeled outside of the classroom or office through a standard-size doorway; therefore, such a design helps to prevent theft of the device 10 and removal of the device 10 from the room for nefarious purposes.

Some doorways have a glass light window adjacent the door. To accommodate such doorways, the panel 20 could be made wider than just the size of the door to encompass the glass light window. For example, the panel 20 might be 5 feet (152 cm) wide. In addition, some doors have a window in them. As shown in FIG. 10, the panel 20 may have a peephole or ballistic door viewer 192 in the panel 20 at a location to align with the window in or adjacent the door. A simple peephole could be formed in (typically, although not necessarily, drilled through) the panel 20. Although it might be small in diameter so as to reduce the risk, a peephole creates a risk that people sheltered by the device 10 would be vulnerable to gun shot through the peephole. To reduce and perhaps eliminate that risk, the ballistic door viewer 192 is inserted through the peephole in the panel 20. A suitable ballistic door viewer 192 is constructed from high grade stainless steel and is available from Blast & Ballistics Ltd. of the United Kingdom. The peephole or ballistic door viewer 192 functions to allow people inside of a room during a lock down to see others outside of the room and decide whether to grant those others access to the room. (In other words, the ballistic door viewer 192 permits viewing or observing through the panel 20.) The people outside the room might be offering help (e.g., first responders, police, security) or they might be an innocent person stranded outside the room who needs to get inside the room for sheltering in place.

Figure 10A:
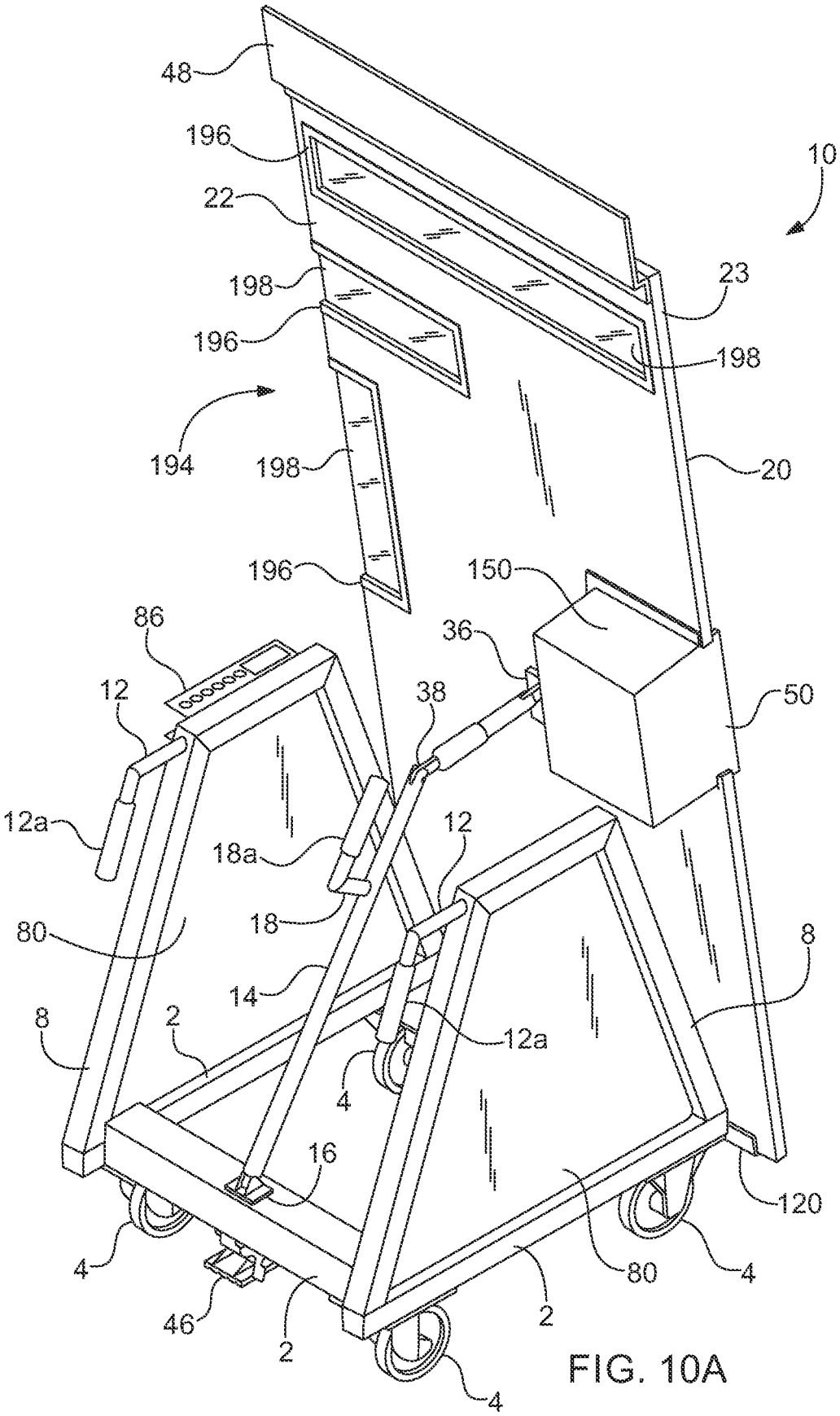
FIG. 10A is a rear, perspective view of an embodiment of the defense mobile device including three embodiments of a ballistic viewport.

Rather than the ballistic door viewer 192, the device 10 can have a ballistic viewport 194 as illustrated in FIGS. 10A (rear, perspective view) and 10B (front, perspective view). Suitable ballistic viewports are commercially available, for example, from JNI Armor of Anaheim, Calif. (jniarmor.com/solutions-applications/ballistic-shield-viewports/). The ballistic viewport 194 provides an expanded (relative to the ballistic door viewer 192) portal or window and, therefore, improves the function of allowing people inside of a room during a lock down to see others outside of the room and decide whether to grant those others access to the room. The ballistic viewport 194 also allows people outside the room to see inside the room and, for example, assess the safety of the people inside the room. The ballistic viewport 194 includes a border 196 which surrounds and supports a transparent, ballistic (i.e., bullet-resistant) glass or fiberglass insert 198.

With reference to the UL 752 Bullet Resistant Materials Standards outlined above, the ballistic level for the ballistic glass or fiberglass insert 198 is rated from Level 1 through Level 8. The ballistic level of the ballistic glass or fiberglass insert 198 will be predetermined for a particular application. The ballistic level should be adequate, however, to stop all handgun rounds, shotgun rounds, and rifle rounds, to include AR-15 style rifles, 0.223/5.56 caliber, and AK-47 caliber bullets of 7.62.

The border 196 is typically made of metal, preferably steel. The various embodiments of the ballistic viewport 194 can be attached to the panel 20, over or in an opening through the panel 20 from the front face 24 to the rear face 22, using fasteners, adhesives, or other attachment mechanisms. The border 196 extends beyond the area defined by the internal opening in the panel 20, which is covered by the glass or fiberglass insert 198, and is preferably disposed flat against the panel 20 when the ballistic viewport 194 is in position against the panel 20. If they are used, fasteners can extend through the panel 20 and through holes in the border 196. Suitable fasteners have an acorn cap or nut. The ends of the fasteners opposite the cap or nut are flush or slightly recessed, of course, with the front face 24 of the panel 20 so as not to interfere with the function of the writing surface.

Figure 10B:
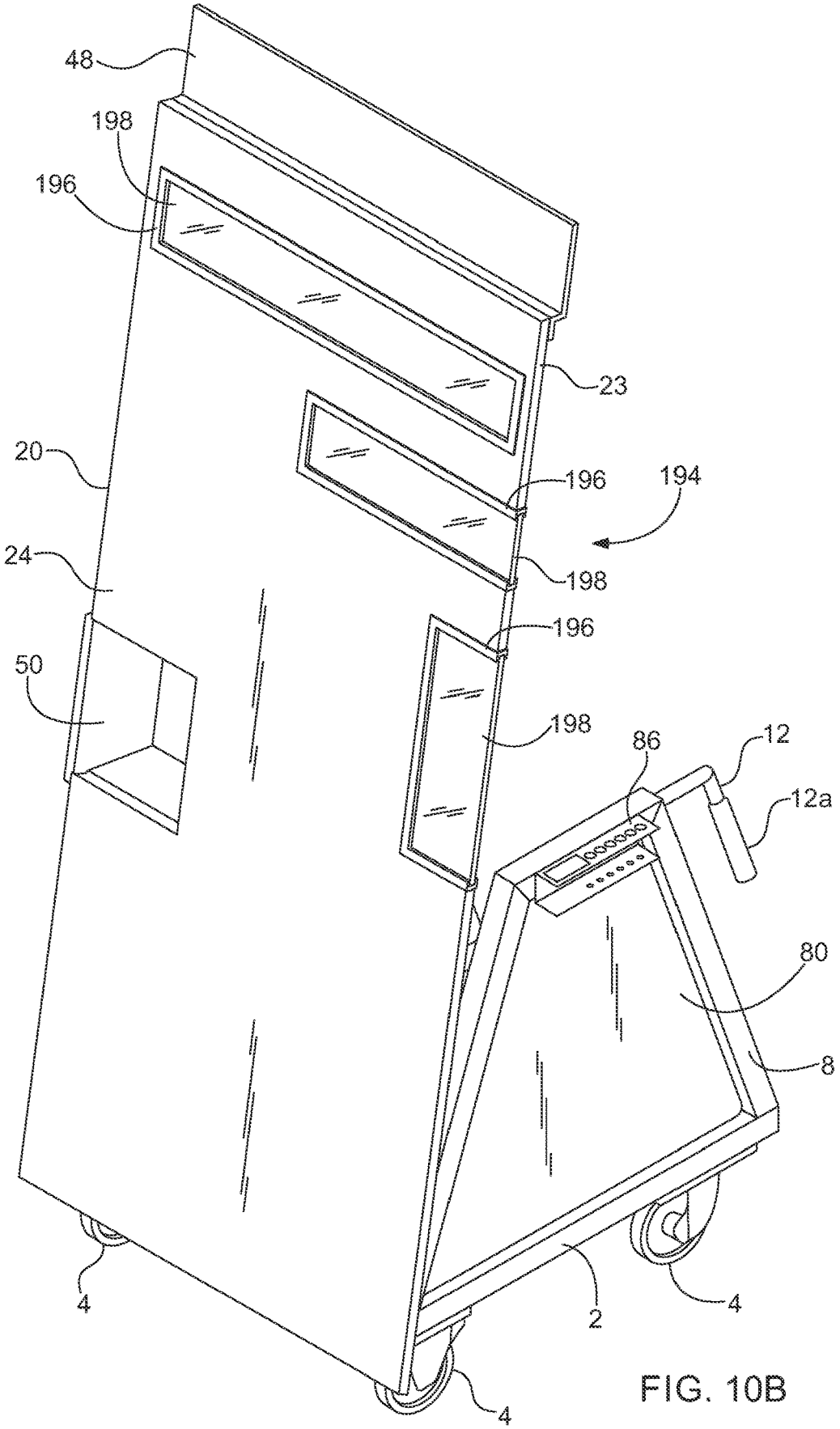
FIG. 10B is a front, perspective view of the embodiment of the defense mobile device shown in FIG. 10A.

FIGS. 10A and 10B illustrate three different embodiments for the size and placement of the ballistic viewport 194. Typically, the panel 20 will include only one of the embodiments, although the panel 20 might include two or, as shown, all three of the embodiments. The ballistic viewport 194 can range in any customizable size. For instance, the ballistic viewport 194 can have a rectangular shape that goes all the way horizontally across the panel 20 of the device 10 (as illustrated near the top of the panel 20) or horizontally part-way (about half-way is illustrated) across the panel 20 of the device 10. The rectangular ballistic viewport 194 can also be installed vertically in the device 10 (as illustrated proximate the center of the panel 20). Of course, other shapes for the ballistic viewport 194 are possible, including square, round, and more, as would be known to an artisan.

This addition of the ballistic viewport 194 makes the device 10 more versatile in its use. The ballistic viewport 194 advantageously permits people who are sheltering in place within a room protected by the device 10 to see directly through the device 10 while constantly being behind cover and protection. With the addition of the ballistic viewport 194, the device 10 is even more suitable for use in such applications as security entrances to any facility for protection (lobbies, office reception areas, etc.) and security checkpoints for law enforcement or security forces such as the military.

Figure 17:
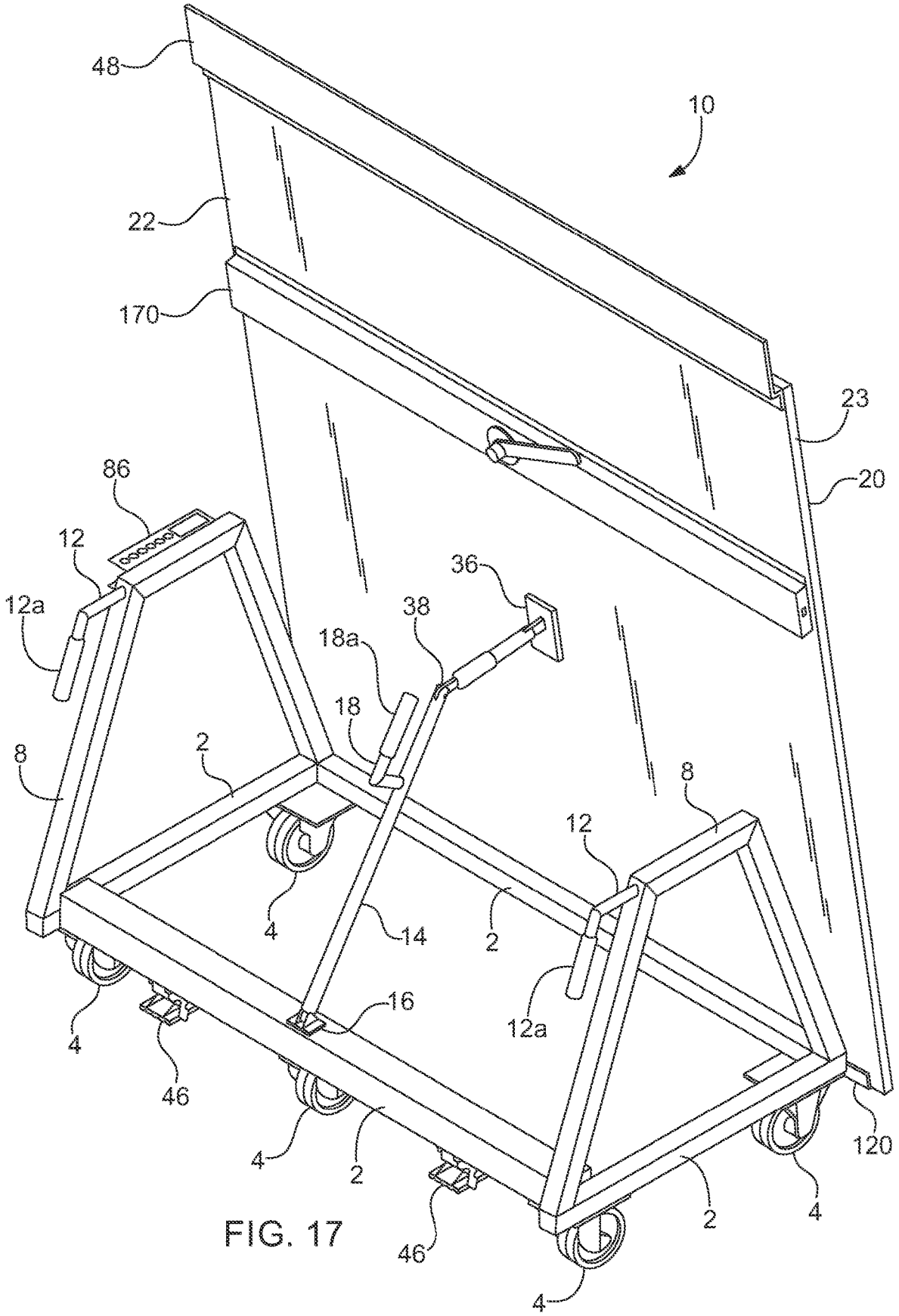
FIG. 17 is a rear, perspective view of the defense mobile device as modified to accommodate a double door.

The device 10 can also be modified to accommodate doors of different sizes. FIG. 17 illustrates the device 10 having a panel 20 sized (i.e., enlarged) to accommodate a double door. Thus, another size for the panel 20 is 1 1/16 inches (2.7 cm) thick by 10 feet (305 cm) wide and 12 feet (365 cm) high. Certain modifications to the enlarged device 10 can be made to facilitate use of the device 10 in connection with an enlarged or double door. Examples of those modifications include an additional wheel 4 (five are shown, rather than four, in FIG. 17) and an additional pedal stop 6 (two are shown, rather than one, in FIG. 17).

Typically, the entire structure of the device 10 (except in some applications, of course, the whiteboard 78 or other components on the front face 24 of the panel 20) will be powder coated. Of course, selective components of the device 10 can be powder coated rather than the entire device 10. Powder coating is a type of coating that is applied as a free-flowing, dry powder. The main difference between a conventional liquid paint and a powder coating is that the powder coating does not require a solvent to keep the binder and filler parts in a liquid suspension form. The coating is typically applied electrostatically and is then cured under heat to allow it to flow and form a "skin." The powder may be a thermoplastic or a thermoset polymer. The powder coating creates a hard finish that is tougher than conventional paint. The powder coating process was invented around 1945 by Daniel Gustin, who was awarded U.S. Pat. No. 2,538,562. The powder coating can give the device 10 any color desired. The powder coating also provides functional advantages, such as toughness and rust resistance.

Figure 18:
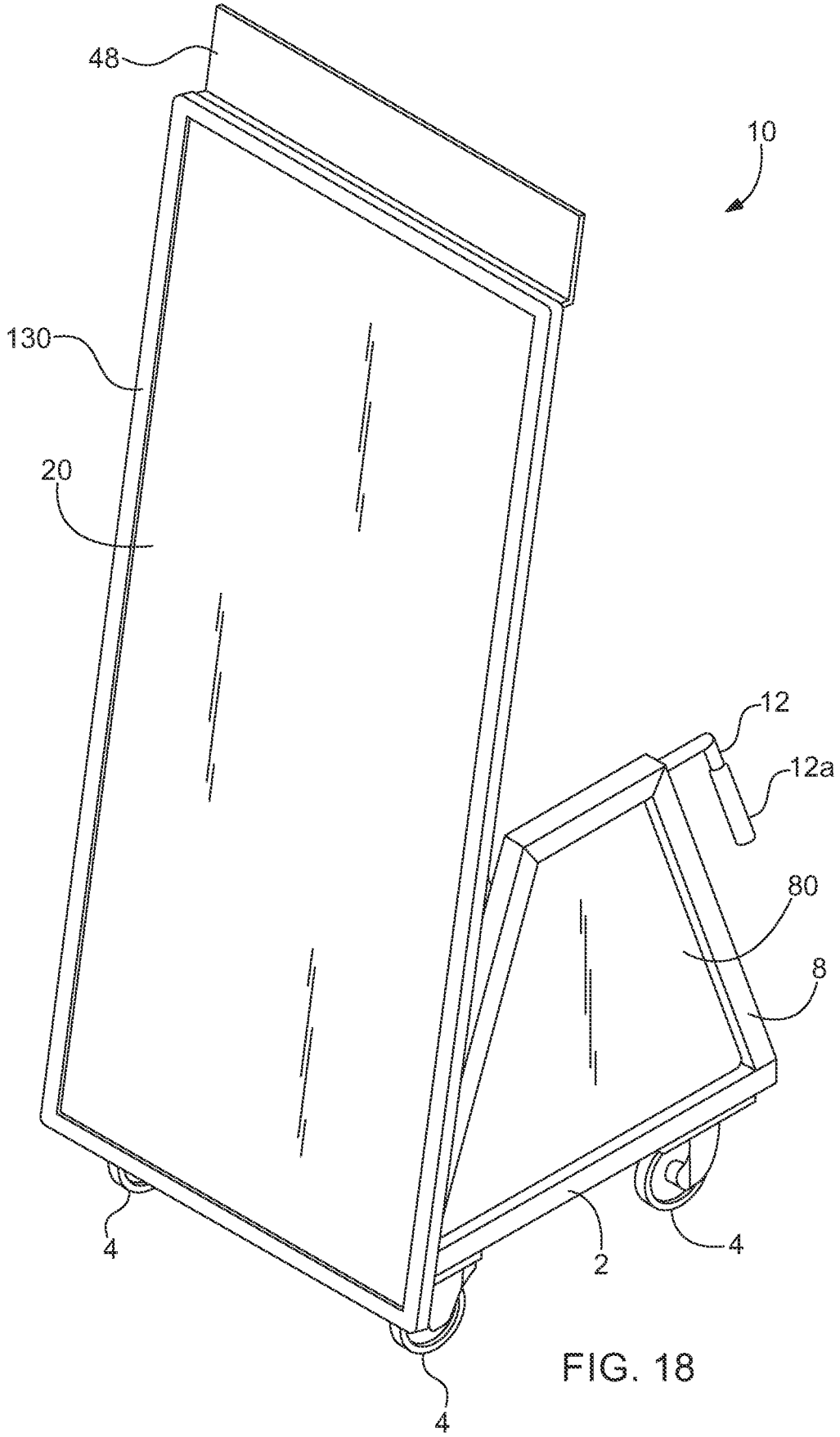
FIG. 18 is a front, perspective view of a different embodiment of the defense mobile device including a protective casing.

The panel 20, with or without the whiteboard 78, can be encased in a protective casing 130. The casing 130 is depicted in FIG. 18 around the panel 20 without the whiteboard 78. The casing 130 can be formed of plastic, rubber, or a similar material. A thin (about 1/16 inches or 0.16 cm thick) aluminum or steel material can also be suitable for the casing 130 in some applications. The casing 130 can be placed over the rear face 22 and the side edges 23 of the panel 20, much as a case is placed over a smartphone. Like smartphone cases, the casing 130 serves many purposes—aesthetics and protection among them. The casing 130 allows the user to personalize the device 10, adding style, color, graphics, and the like. The casing 130 also protects the panel 20 (and whiteboard 78) from various damage risks such as chipping and cracking. Still further, the casing 130 protects other objects (walls, desks, etc.) that might be inadvertently bumped by the device 10. The casing 130 also may provide a support to which other components (such as the "L"-shaped band 120) can be attached.

Figure 19:
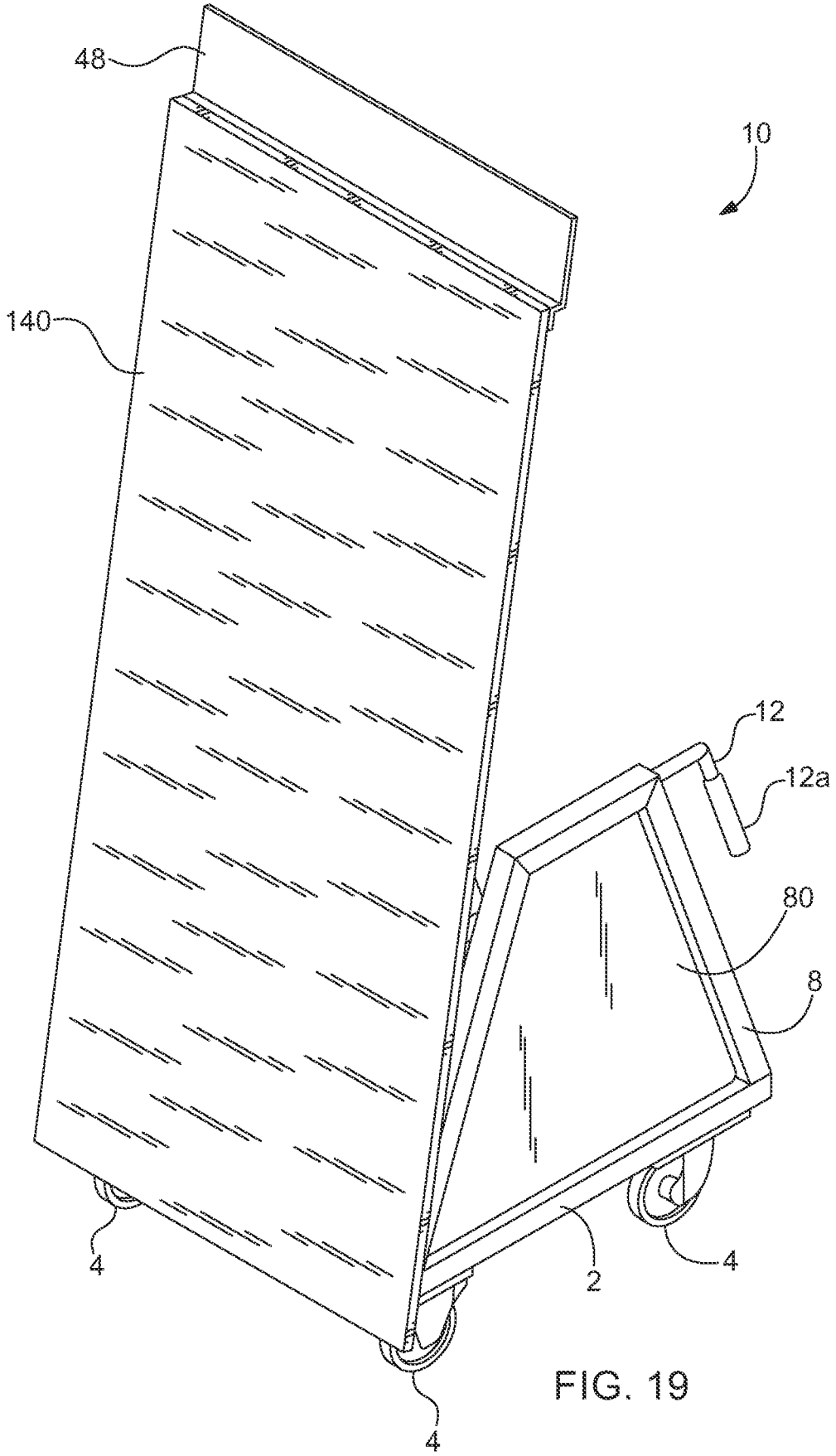
FIG. 19 is a front, perspective view of one more embodiment of the defense mobile device including a wrap.

One or more of the components of the device 10 can be encased in a wrap 140, typically made of plastic such as vinyl. An embodiment of the device 10 illustrating the wrap 140 as applied to the panel 20 is shown in FIG. 19. Products like the wrap 140 are often used to encase automobiles. The main goals of the wrap 140 are to change the appearance of the device 10 (i.e., improve its aesthetics), help preserve the device 10, and provide a medium of expression for the user. Thus, the wrap 140 can change or provide a color to the device 10 without painting or repainting the device 10. The wrap 140 can enhance the appearance of the device 10 for a lower cost than a paint job. The wrap 140 can also give the user the option of adding to the device 10 a school name, logo, and/or mascot; the name of a place of worship and/or logo; the name of a government entity and/or logo; the name of a military branch and/or logo; the name of a business and/or logo, advertising a product or service, or even presenting a message such as a political point of view. In short, the user can customize the color of, and communicate a message through, the wrap 140 of the device 10. The wrap 140 must have a solid surface to adhere to; otherwise it will not stick. The user can leave the wrap 140 in place on the device 10 for as long as desired, replace the original wrap 140 with a new wrap 140, or remove the wrap 140 and return the device 10 to its previous color. The wrap 140 is easy to clean.

Typically, the first level of protection against an intruder having access to a room is a locked door 90. As shown in FIG. 4, the door 90 has a knob 92 and a latch 94. The knob 92 may be a conventional round knob, a handle, a rotating lever, or similar mechanism used to open the conventional door 90. The user grasps, rotates, pushes, and pulls the knob 92 to open and close the door 90. The latch 94 engages a corresponding latch plate in the door frame 98 to lock the door 90 into position within the door frame 98. (Note that the door jambs, also called the door "legs," are the interior sides of the door frame 98 and, specifically, the parts of the door frame 98 that hold the mounting hinges on one side and the strike or latch plate for the latch on the other.) The device 10 enhances the first level of protection by adding three more levels of protection. The ballistic panel 20 provides a second level of protection (in addition to acting as a whiteboard as described above).

The design and intent of the ballistic panel 20 is to be placed against the existing, already-locked door 90. The panel 20 is positioned, as shown in FIG. 4, perpendicularly (i.e., at a 90-degree angle) to the floor 100 and flat against the door 90. In this position, the panel 20 provides ballistic protection against bullets being fired into the existing door 90. The bullets may travel through the door 90 and then into the ballistic panel 20 itself, which absorbs or captures the bullets and provides a second layer of security.

The panel 20 pivots mechanically so that it can transition from its secondary function as a whiteboard, typically although not necessarily angled as shown in FIG. 3, to being engaged at a 90-degree angle against a door and its door frame 98 for its primary, safety function, as shown in FIGS.

4 and 5. Two mechanical features of the device 10 enable the panel 20 to transition. First, the pivots 30 (which may be a bolt-and-hinge combination) are located near the bottom of the ballistic panel 20 so that the ballistic panel 20 can be engaged into a 90-degree position. Second, for the ballistic panel 20 to be engaged into the 90-degree position, the user-friendly locking rod 14 pushes the panel 20 into its upright 90-degree position. The first and second hinge bolts 16 and 36 fix opposite ends of the locking rod 14 to the base 2 and to the panel 20, respectively. Noteworthy is that a single locking rod 14 pivots the panel 20 through its various angled positions and into its upright 90-degree position, and back again; multiple pivot mechanisms are unnecessary.

Optionally provided is one stay 32 or a pair of stays 32, each stay 32 having one end connected to the frame 8 and its opposite end connected to the panel 20. See FIG. 1. The stays 32 assist the locking rod 14 in positioning the panel 20 relative to the frame 8 and to the door 90. The stays 32 also help the frame 8 to support the panel 20.

Also optionally provided are one or more hydraulic lifts 150 to assist in moving the panel 20 from its normal resting position to a 90-degree position fully engaged against a door 90 or door frame 98. Two hydraulic lifts 150 are shown for purposes of example only in FIG. 11, which is a rear, perspective view of another embodiment of the defense mobile device 10. (The lifts 150 might also be called gas spring struts, struts, gas props, or lift supports and are available commercially from, for example, SiraWeb.com of Willoughby, Ohio (www.siraweb.com).) An hydraulic lift is a type of machine that uses an hydraulic apparatus to lift or move heavy objects (such as the panel 20) using the force created when pressure is exerted on liquid in a piston. The force produces the useful "lift." One of the physics equations that applies to hydraulic lift technology is "pressure× area=force." This equation helps to determine the pressure exertion required on a liquid in a piston to produce enough force to provide lift and move an object. Each lift 150 has one end connected to the frame 8 and its opposite end connected to the panel 20. Alternative or in addition to the lifts 150 connected to the frame 8, a lift can be added to the locking rod 14 to assist in putting the locking rod 14 into place. The lifts 150 give the user more control over movement of the panel 20 and help with a smoother transition when placing the panel into a 90-degree position against a door 90.

Figure 6:
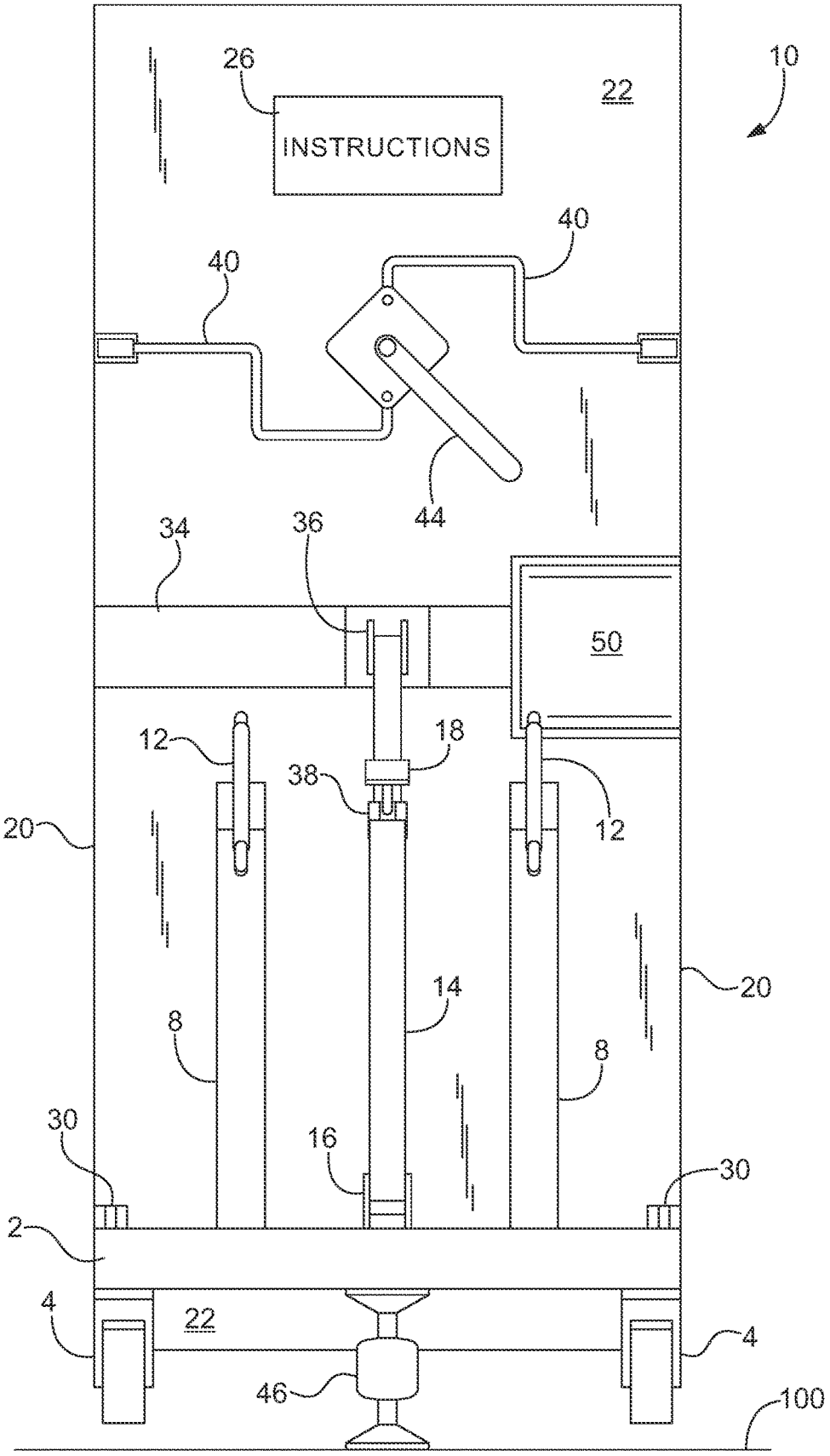
FIG. 6 is a rear view of the defense mobile device illustrating alternative embodiments of the lever-locking mechanism and of the stop.

The device 10 adds a third layer of protection against an intruder by providing a lever-locking mechanism to secure the device 10 in place against or within the existing door frame 98. The lever locking mechanism includes, for example, one or more bolts 40 (preferably steel) slidably located on the panel 20 of the device 10 and a corresponding one or more receivers (or sleeves) 42 (also preferably steel) located on the existing door frame 98. Two bolts 40 and receivers 42 are illustrated in FIG. 5. As illustrated in FIG. 5, one pair of bolts 40 and receivers 42 is located on either side of the existing door frame 98. Each bolt 40 has a handle 44 to facilitate manipulation of the bolt 40 by a user. FIG. 6 illustrates an alternative embodiment of the lever-locking mechanism, with a single handle 44 allowing the user to manipulate both of the bolts 40 simultaneously.

After the user positions the panel 20 upright against the door 90, the one or more bolts 40 can be slid along the panel 20 into engagement with the corresponding one or more receivers 42. One pair of a bolt 40 and a receiver 42 suffices; two or more pairs of bolts 40 and receivers 42 provide enhanced security. Regardless of the number of pairs of bolts 40 and receivers 42, the lever-locking mechanism provides a third layer of protection in case the existing door 90 is breached by an intruder: the intruder faces the panel 20 locked into position against or within the existing door frame 98 even with the door 90 damaged, opened, or removed.

A problem with many lockdown procedures is that fire safety codes typically mandate the use of outward-opening doors 90, and the use of locks that are key-locked from outside the room and released by simply turning the door knob 92 from inside the room. These fire safety measures interfere with the speed and security of the lockdown procedure. The teacher must open the classroom door, step outside, and key the lock, exposing the teacher and the classroom to danger. Further, a panicked student can easily unlock the door 90 from inside the classroom. Still further, if the door 90 has the typical glass window, an intruder can break the glass, reach inside, and unlock the door 90 by turning the inside door knob 92.

The device 10 is designed to engage door frames 98 whether the corresponding door 90 opens into the room or outward away from the room. The lever-locking mechanism (one or more bolts 40 and receivers 42) can be shaped to engage both protruding and recessed door frames 98. In either case, the receivers 42 are affixed to the door frame 98. The corresponding bolts 40 will be substantially straight to accommodate outward-opening doors 90 (in a recessed door frame 98) and will have a substantially "Z" or "S" shape to accommodate inward-opening doors 90 (in a protruding door frame 98).

Figure 11:
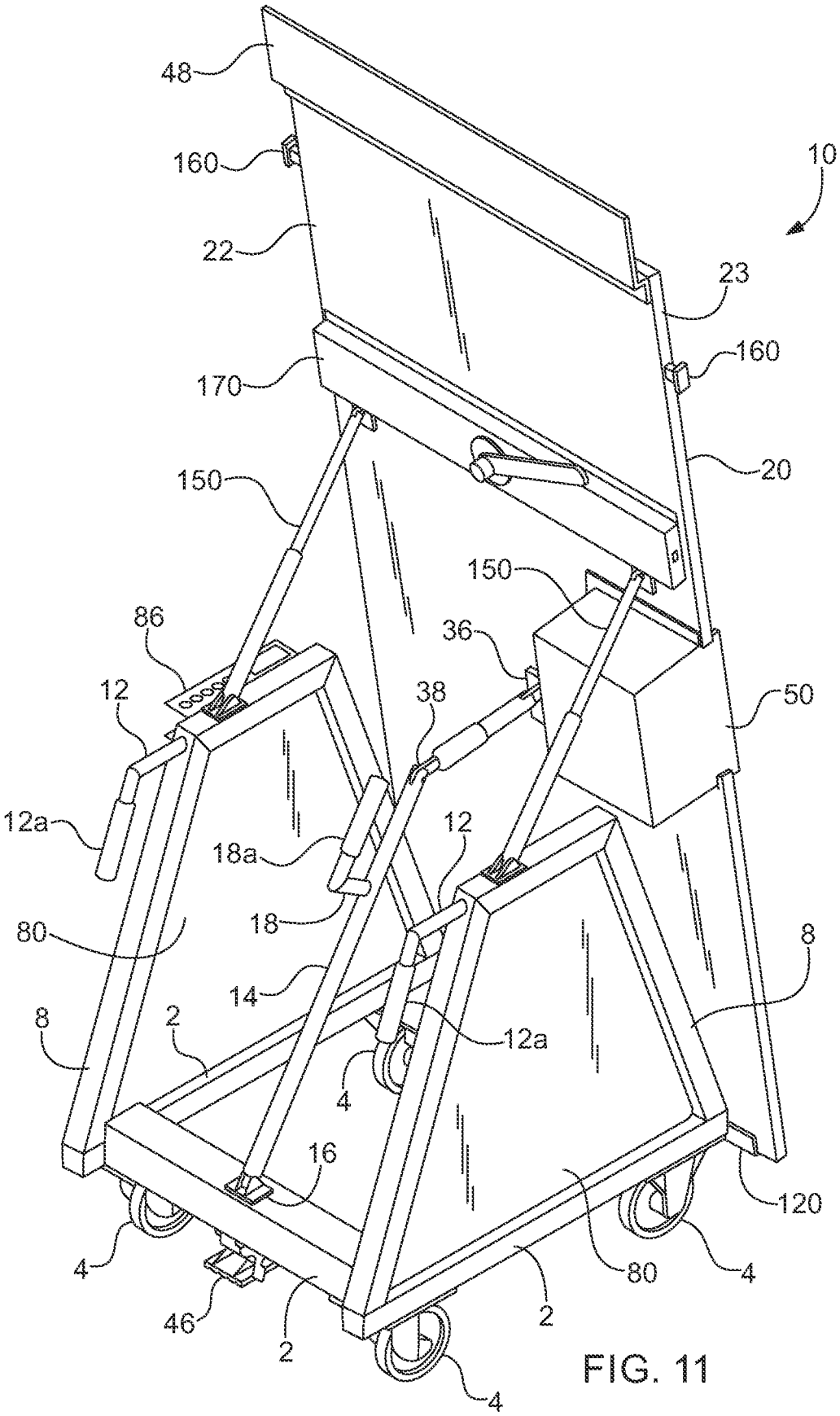
FIG. 11 is a rear, perspective view of still another embodiment of the defense mobile device including magnets and two hydraulic lifts.

One or more magnets 160 can be affixed to each side edge 23 of the panel 20, as shown in FIG. 11, especially when the device 10 is used on doors 90 that open inwardly. The magnets 160 can have any suitable shape, including round, square, rectangular, etc. When the panel 20 and, if applicable, the whiteboard 78 are fully engaged at 90 degrees against the door 90 or door frame 98, the magnets 160 will attach to the door frame 98 (i.e., the existing metal door frame). Such magnetic attachment provides additional strength to the barricade created by the panel 20 and renders it more difficult for forced entry from the side of the door 90 opposite the device 10. Thus, the magnets 160 help to strengthen the barricaded door 90 or door frame 98.

Figure 20:
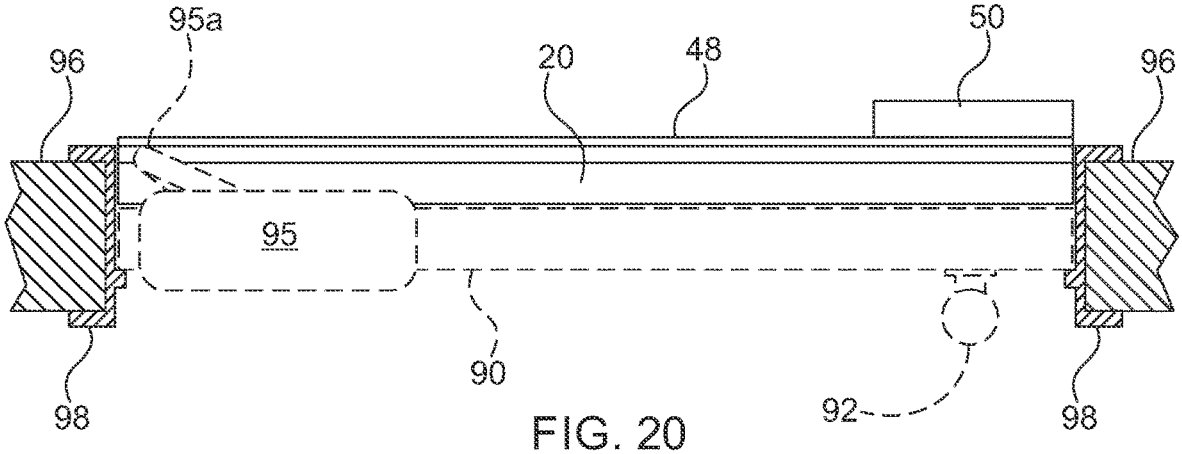
FIG. 20 is a top view of the defense mobile device engaging a door with the device modified to accommodate a door closer.

As discussed above, modifications to the device 10 may be made to accommodate certain applications. Another such modification is to add to the device 10, and specifically to the panel 20, a top step 48 preferably made of steel. The top step 48 is illustrated in many of the figures including, for example, FIG. 10. The purpose of the top step 48 is to accommodate a door 90, typically an outward-opening door 90, that has a door closer 95. As illustrated in FIG. 20, the door closer 95 may have a piston 95*a* that projects into the room. Regardless, the door closer 95 may prevent the panel 20 from extending upward the full height of the doorway (i.e., the door closer 95, or at least the piston 95*a*, blocks the panel 20 from extending to and contacting the top of the doorway). Rather than leave an opening at the top of the doorway, the device 10 includes the top step 48 to close that opening. The top step 48 is affixed to the rear face 22 of the panel 20 and is either flat or "L"-shaped, depending upon how much clearance the top step 48 must provide to accommodate the door closer 95 and its piston 95*a*. A flat top step 48 will provide a clearance equal to the thickness of the panel 20 (typically about 1 inch or 2.5 cm). An "L"-shaped top step 48 will provide a greater clearance: if the horizontal leg of the "L" is two inches or about 5 cm, for example, then a clearance equal to about 3 inches or 7.5 cm can be provided.

The device 10 effectively barricades even outward-opening, doorknob-operated doors 90 from inside a room without having to open or lock the door 90. Externally locked, internally unlocked door knobs 92 do not compromise the security of the device 10, even if the door knob 92 is left unlocked during the lockdown procedure.

The lever-locking mechanism (bolts 40 and receivers 42) of the device 10 can be manually operated by the user or can be designed to engage automatically and to be released by remote signal from the controller 66. A manually operated embodiment of the lever-locking mechanism is illustrated in FIG. 5.

In order to further prevent the possibility of the door 90 being unlocked from inside the room, or by someone reaching through a broken window and unlocking the door 90, and to increase the speed of the deployment of the lever-locking mechanism, an alternate, automatically engaged lever-locking mechanism forms an alternative embodiment. The automatic lever-locking mechanism includes a bolt 40 mounted to move in a bore under the action of a spring. The bolt 40 is retracted into the bore and out of engagement with the receiver 42 against the force of the spring by a retention element. When it is desired that the spring push the bolt 40 out of the bore and into engagement with the receiver 42 located on the door frame 98, the retention element is released. Such release automatically pushes the bolt into engagement with the receiver 42.

The bolt 40 and its corresponding spring are part of a remote-controlled, solenoid-retracted lever-locking mechanism. The automatic lever-locking mechanism is similar, for example, to the mechanism used in remote-controlled automobile door lock mechanisms. Transmitting one signal to the lever-locking mechanism causes the solenoid to retract the bolt 40 out of engagement with the receiver 42, against the force of the spring, allowing the panel 20 and the device 10 to be removed from the door 90 and door frame 98. A wireless unlatching signal can come from a handheld remote control in the possession of a teacher, or from security personnel clearing the building, or can be a building-wide signal transmitted from a central office. The signal can be part of the communications 64 from the transceiver 68 prompted by user interface with the controller 66.

Figure 21A:
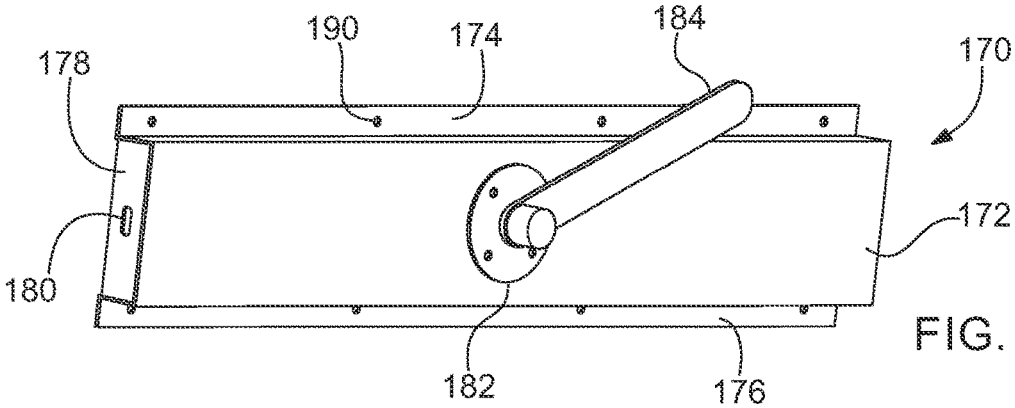
FIG. 21A is a rear perspective view of the twist-lock mechanism included with some embodiments of the defense mobile device.
Figure 21B:
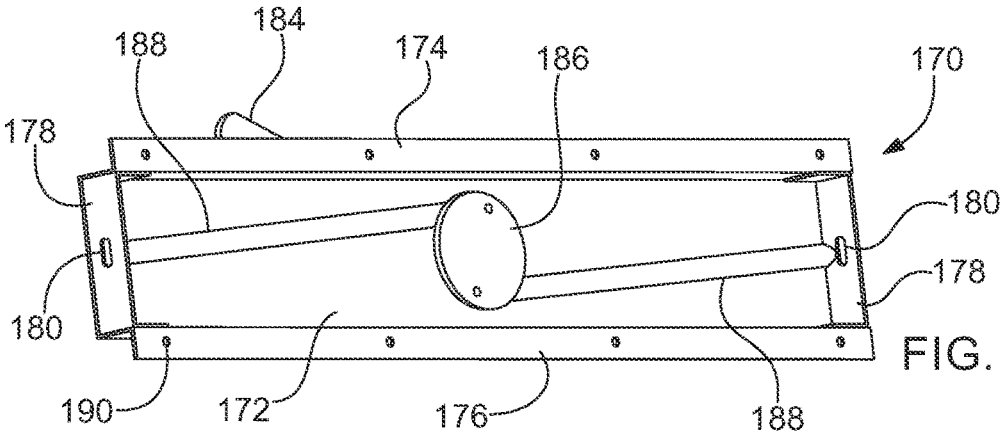
FIG. 21B is a front perspective view of the twist-lock mechanism shown in FIG. 21A.

Another alternative is to include a twist-lock mechanism 170 as part of the device 10. FIG. 21A is a rear perspective view and FIG. 21B is a front perspective view of the twist-lock mechanism 170. As illustrated in many of the figures including, for example, FIG. 10, the twist-lock mechanism 170 is attached to the rear face 22 of the panel 20 at about the middle of the height of the panel 20.

The twist-lock mechanism 170 has an enclosure 172 with a top flange 174, a bottom flange 176, and side flanges 178. Each of the side flanges 178 has a slot 180. At the approximate center of the rear of the enclosure 172 a disc 182 is located having a twist-lock handle 184. Through an axel, bushings, and hole (not shown) in the enclosure 172, the disc 182 engages a twist-lock plate 186 located inside the enclosure 172. The twist-lock plate 186 has pivotably connected to it a pair of twist-lock arms 188 that each extend, respectively, through one of the slots 180 when the twist-lock mechanism 170 is actuated and that retract completely inside the enclosure 172 when the twist-lock mechanism 170 is not actuated. The top flange 174 and the bottom flange 176 can attach the twist-lock mechanism 170 to the rear face 22 of the panel 20 using a variety of fasteners 190 such as screws, bolts, tacks, rivets, and the like, as would be appreciated by an artisan.

The ends of the twist-lock arms 188 opposite the twist-lock plate 186 are configured to engage corresponding notches on the door frame 98 when the twist-lock mechanism 170 is actuated. Such engagement further enhances the barricade created by the device 10. Actuation is achieved when the twist-lock handle 184 is rotated in a first direction, which causes the disc 182 and in turn the twist-lock plate 186 to rotate in that same first direction. Such rotation causes the twist-lock arms 188 to move outward, through the slots 180, and into engagement with the notches. Actuation can be accomplished manually or automatically. When the user wants to remove the device 10 from its position in the door frame 98, the twist-lock handle 184 is rotated in a second direction opposite to the first direction, which causes the disc 182 and in turn the twist-lock plate 186 to rotate in that second direction. Such rotation causes the twist-lock arms 188 to move inward, through the slots 180, and into the interior of the enclosure 172 as shown in FIG. 21B.

The device 10 adds a fourth layer of protection against an intruder by providing a cover 50 on the panel 20. (As illustrated in FIG. 10, the frame 8 has a "Z"-shaped cutout to accommodate interaction between the frame 8 and the cover 50.) As illustrated in FIG. 3, the cover 50 is affixed to the panel 20 over an opening 52 that is cut in the panel 20. The opening 52 is sized and shaped to permit the door knob 92 to protrude through the panel 20 when the panel 20 is placed against the door 90. This allows the panel 20 to be placed flat against the door 90 regardless of the size of the hardware used on the door 90. The cover 50 is designed to overlay and enclose the door knob 92, when the door knob 92 protrudes through the panel 20, regardless of the type (e.g., round knob, rotating lever, handle, or other) and shape of the door knob 92.

In one embodiment, the cover 50 is formed in the shape of a metal (preferably steel) box. The opening 52 in the panel 20 may be round, square, rectangular, U-shaped, or may have any other shape suitable to accommodate a door knob 92. The cover 50 may have a shape corresponding to the shape of the opening 52. An example cover 50 is a rectangular box formed of half-inch (1.25 cm) thick steel which is about 5 inches (12.5 cm) deep, 10 inches (25 cm) tall, and 8 inches (20 cm) wide. Other dimensions are suitable, however, for the cover 50 (e.g., ⅜ inch or 1 cm thick). When in position enclosing the door knob 92, the cover 50 prevents inadvertent unlocking or opening of the door 90 and protects against an intruder who might shoot out the door knob 92.

Figure 7:
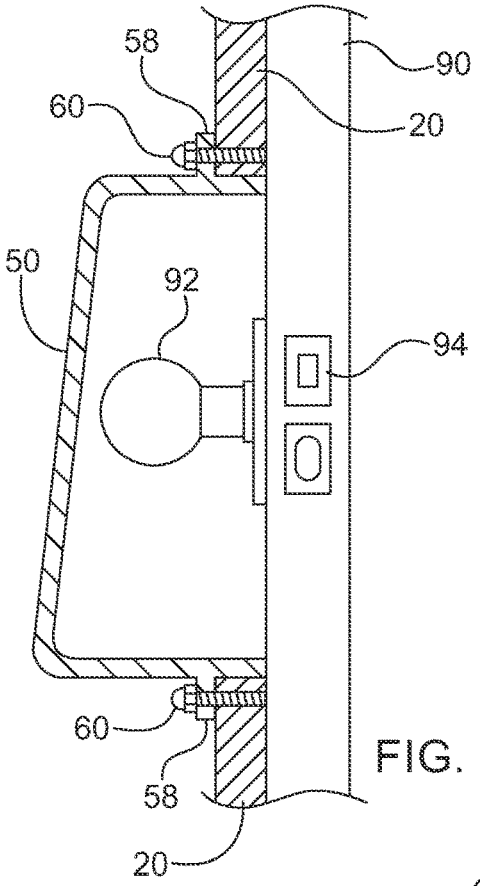
FIG. 7 is a side view, in partial cross section, of an alternative embodiment of the cover of the defense mobile device.
Figure 8:
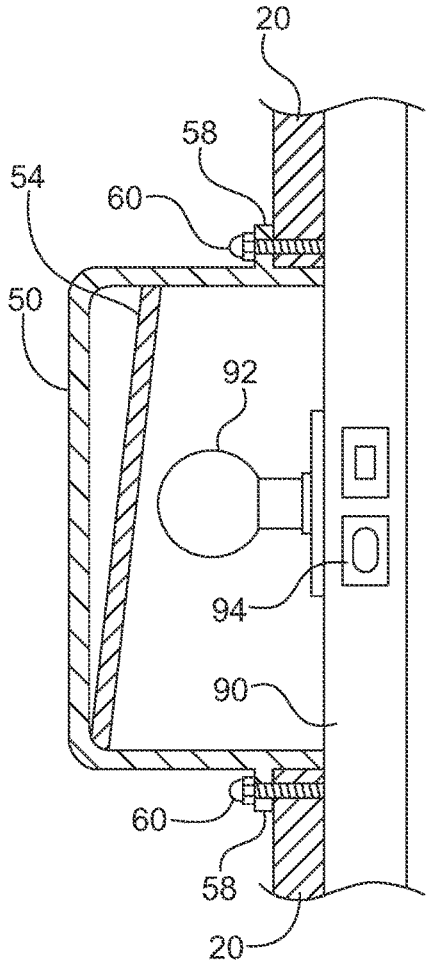
FIG. 8 is a side view, in partial cross section, of a further alternative embodiment of the cover of the defense mobile device.
Figure 9:
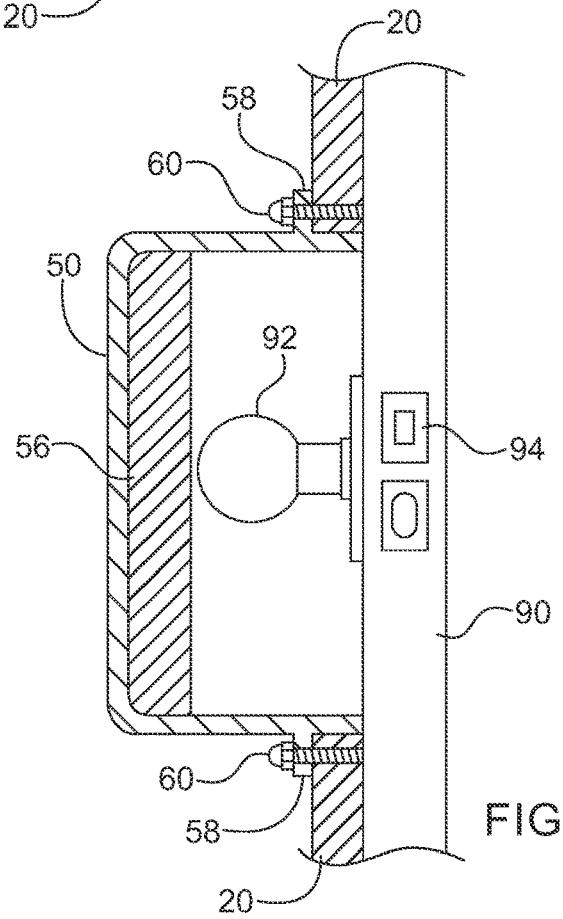
FIG. 9 is a side view, in partial cross section, of a still further alternative embodiment of the cover of the defense mobile device.

FIGS. 7, 8, and 9 are side views, in partial cross section, of alternative embodiments of the cover 50. In FIG. 7, the cover 50 is angled so that projectiles such as bullets penetrating the door 90 and passing through the opening 52 are deflected downward toward the floor 100. In FIG. 8, the cover 50 appears outwardly like the box embodiment illustrated in FIGS. 1-5, but has an internal angled deflector 54. The deflector 54 is preferably made of metal (e.g., steel) and functions to deflect projectiles. In FIG. 9, the cover 50 appears outwardly like the box embodiment illustrated in FIGS. 1-5, but has an internal insert 56. The insert 56 is preferably made of the same material as the panel 20, so that the insert 56 catches any projectile penetrating the door 90 and passing through the opening 52.

As shown in FIGS. 7, 8, and 9, the various embodiments of the cover 50 can be attached to the panel 20 using fasteners 60. The cover 50 has one or more flanges 58 that extend beyond the area defined by the internal opening of the cover 50, and are preferably disposed flat against the panel 20 when the cover 50 is in position against the panel 20 and over the knob 92 of the door 90. The fasteners 60 extend through the panel 20 and through holes in the flanges 58. Suitable fasteners 60 have an acorn cap or nut. The end of the fasteners 60 opposite the cap or nut are flush or slightly recessed, of course, with the front face 24 of the panel 20 so as not to interfere with the function of the writing surface.

Optionally provided on the rear face 22 of the panel 20 is a belt 34. The belt 34 is preferably metal and still more preferably steel. The belt 34 reinforces the panel 20 and facilitates engagement between the panel 20 and one or more of the hinge bolt 36 (and, therefore, the locking rod 14), the stays 32 (if present), and the cover 50. Such engagement is illustrated, for example, in FIG. 1. The hinge bolt 36, the stays 32, and the cover 50 can be welded to the belt 34.

The device 10 can be modified to permit certain people (i.e., authorized entrants) located outside a room to gain access to the room without assistance from occupants in the room. Such authorized entrants might be offering help (e.g., first responders, police, security, firefighters, or emergency personnel) or might be stranded outside the room and need to get inside the room for sheltering in place. Access to the room can be gained by moving the device 10 away from the door after releasing the mechanism that otherwise prevents the device 10 from moving. As described above, that mechanism can be one or both of pedal stops 6 and stops 46. The pedal stops 6 and stops 46 are provided on the device 10 to hold the device 10 in a stationary position and prevent moving the device 10. Release or deactivation of the pedal stops 6, the stops 46, or both can be achieved using a release system 200. Thus, although the release system 200 will be described and is illustrated in FIGS. 22-26 in connection with the stop 46, the same principles would apply in connection with the pedal stop 6.

Figure 22:
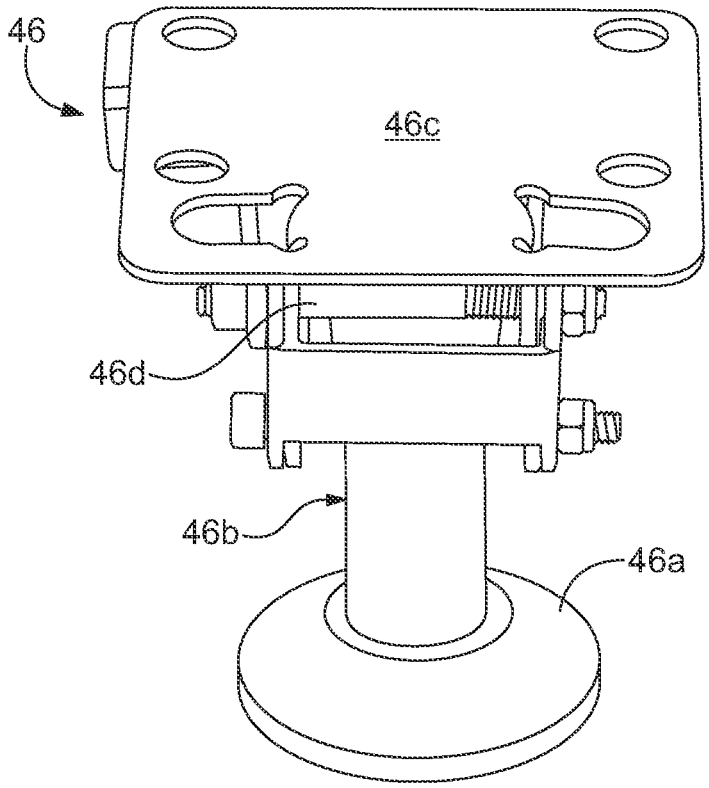
FIG. 22 is a front, perspective view of the stop illustrated in FIGS. 6 and 10.
Figure 23:
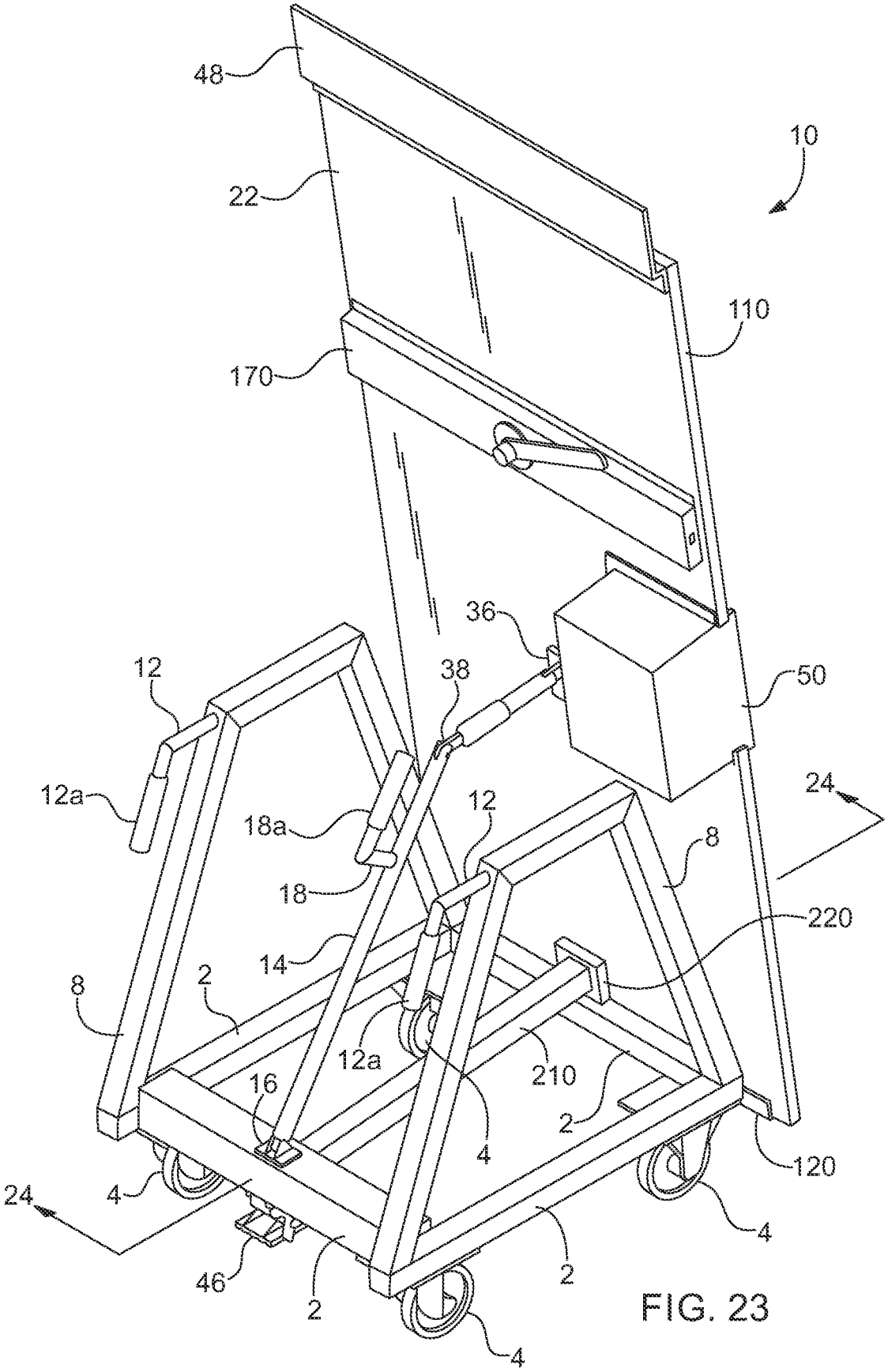
FIG. 23 is a rear, perspective view of another embodiment of the defense mobile device illustrating several components of a release system.

In one embodiment, as illustrated in FIG. 22, the stop 46 includes a pedestal 46*a*, a body 46*b*, and a plate 46*c*. The pedestal 46*a* is configured to engage the floor 100 or other surface on which the device 10 rests. The plate 46*c* engages the base 2 of the device 10, attaching or affixing the stop 46 to the base 2. As stated above, the stop 46 may be affixed to the base 2 at a location removed from the wheels 4 such that, when activated, the stop 46 contacts the floor 100 or other surface on which the wheels 4 would otherwise roll and prevents the wheels 4 from rolling. The body 46*b* structurally connects the pedestal 46*a* and the plate 46*c*. When the stop 46 is deactivated, the pedestal 46*a* pivots upwardly and disengages from the floor 100, allowing the wheels 4 to roll and the device 10 to move. Relevant to the release system 200, the stop 46 also includes a pin or bolt 46*d*. Tension applied to the bolt 46*d* deactivates the stop 46.

As illustrated in FIGS. 23-26, the release system 200 includes a cord or cable 202. Preferably made of steel, and more preferably 3/16 inches (0.5 cm) thick, vinyl-coated, galvanized, steel wire, the cable 202 is attached on one of its two ends to the stop 46. In the embodiment shown, the end of the cable 202 that is attached to the stop 46 forms a first loop 204. The first loop 204 encircles the bolt 46*d* of the stop 46. Therefore, a pulling force applied to the first loop 204 also applies tension to the bolt 46*d*, deactivating the stop 46. The end of the cable 202 that is opposite to the stop 46 forms a second loop 206.

The release system 200 further includes a hollow tube 210 and a hollow box 220. Both the tube 210 and the box 220 are preferably made of metal and, even more preferably, of steel. The tube 210 can have any suitable shape in cross section, such as square, rectangular, or round. The tube 210 can have a smooth interior surface or a threaded interior surface. One end of the tube 210 is attached (e.g., welded) to the base 2 of the device 10 proximate to the stop 46. The opposite end of the tube 210 is attached (e.g., welded) to the box 220. The tube 210 can be disposed substantially parallel to the floor 100 (i.e., flat) between the stop 46 and the box 220 if the box 220 is located near the bottom of the panel 20. Alternatively, as illustrated in FIG. 24, the tube 210 can be angled upward from proximate the stop 46 to the box 220, allowing the box 220 to be located at almost any position and height on the panel 20 (see the dashed positions of the tubes 210*a* and 210*b* illustrated in FIG. 24, which is a side view in partial cross section taken along the line 24-24 of FIG. 23).

The cable 202 is threaded, runs through, or otherwise traverses inside of the tube 210 from the stop 46 to the inside of the box 220. The cable 202 can enter the inside of the tube 210 through an orifice 211 in the tube 210. The first loop 204 of the cable 202 engages the stop 46, as described above, and the second loop 206 of the cable 202 resides inside the box 220 proximate the rear face 22 of the panel 20.

Figure 24:
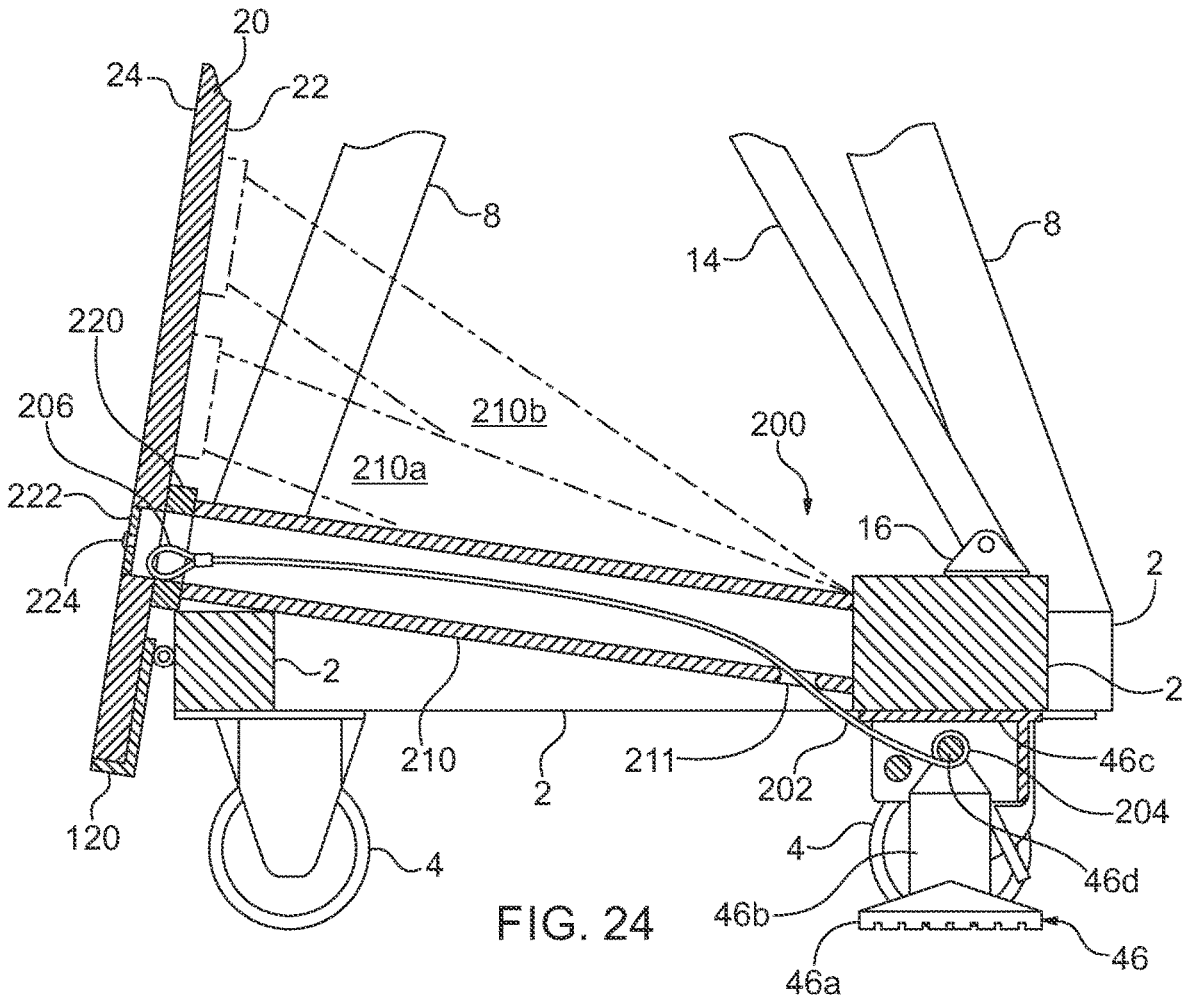
FIG. 24 is a side view, in partial cross section, of the defense mobile device shown in FIG. 23 illustrating additional components of the release system.
Figures 25, 26:
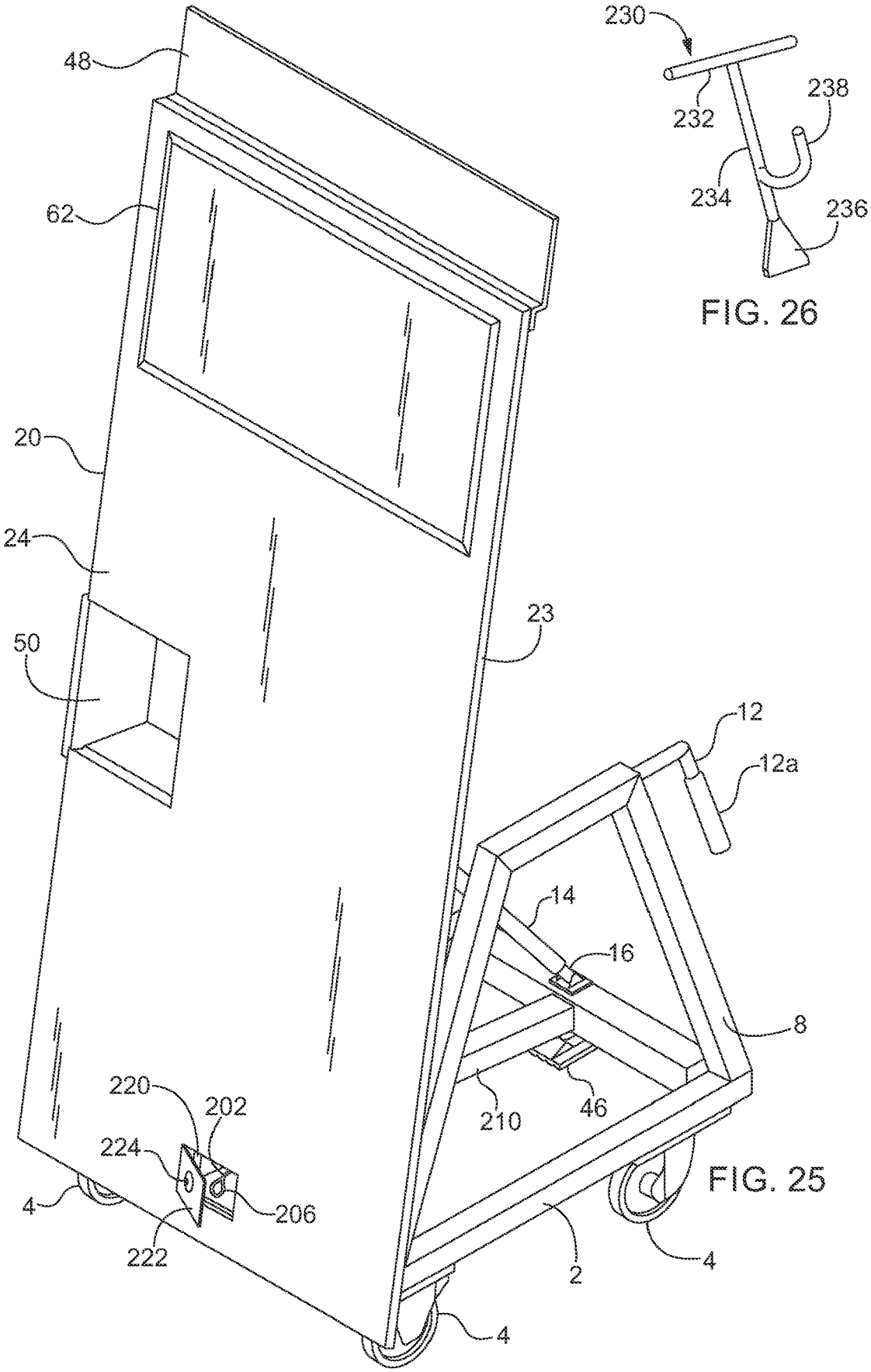
FIG. 25 is a front, perspective view of the defense mobile device shown in FIGS. 23 and 24.
FIG. 26 illustrates a key that can be used as one component of the release system.

As illustrated in FIGS. 24 and 25, the box 220 is affixed to the panel 20 on the rear face 22 of the panel 20 and over an opening that is cut in the panel 20. The opening is sized and shaped to permit an authorized entrant to access the second loop 206 of the cable 202 that resides in the box 220. The box 220 has a door or hatch 222 that closes the box 220 and lies flush with the front face 24 of the panel 20. This allows the panel 20 to be placed flat against the door 90. The hatch 222 has a key hole 224 configured to receive a key 230. The hatch 222 locks the box 220, preventing access to the cable 202 residing in the box 220, until and unless the hatch 222 is opened using the key 230. The key 230 must only be accessible to (e.g., stored safely in a school resource office, at a local police or fire department, or in a facilities management office) or carried by authorized entrants.

The shape of the box 220 may be round, square, rectangular, U-shaped, or may have any other shape suitable to accommodate the second loop 206 of the cable 202. Of course, the opening in the panel 20 covered by the box 220 will have a corresponding shape. An example box 220 is a rectangular box formed of half-inch (1.25 cm) thick steel which is about 5 inches (12.5 cm) deep, 10 inches (25 cm) tall, and 8 inches (20 cm) wide. Other dimensions are suitable, however, for the box 220 (e.g., 3/8 inch or 1 cm thick). When in position enclosing the second loop 206 of the cable 202, with its hatch 222 locked closed, the box 220 prevents undesired access to the cable 202 and, therefore, deactivation of the stop 46. Thus, the box 220 protects against an intruder who might access the cable 202.

An embodiment of the key 230 is illustrated in FIG. 26. The key 230 is preferably T-shaped, with a horizontal head 232 and a vertical leg 234. An unlocking tip 236 is located at the end of the vertical leg 234 opposite the head 232. A hook 238 is located along the leg 234 between the unlocking tip 236 and the head 232. The unlocking tip 236 is configured to enter the key hole 224 and unlock the hatch 222 of the box 220, permitting access by an authorized entrant who possesses the key 230 to the cable 202 residing in the box 220. The authorized entrant can then grasp the head 232 of the key 230 and use the hook 238 to grab the second loop 206 of the cable 202 and pull on the cable 202, which will deactivate the stop 46 and permit the authorized entrant to move the device 10 away from the door 90 and gain access to the room.

In an alternative embodiment, the key 230 may be a conventional key having the unlocking tip 236 only. This embodiment of the key 230 need not be T-shaped, nor need it have the hook 238. The function of this embodiment of the key 230 is simply to open the hatch 222. Once the authorized entrant opens the hatch 222 and has access to the second loop 206 of the cable 202, the authorized entrant can grab the second loop 206 directly using one or more fingers. Also possible is that a separate T-shaped hook 238 either is permanently attached to the second loop 206 or resides in the box 220 (along with the cable 202). In either case, after the authorized entrant has opened the hatch 222 using the key 230, the authorized entrant can use the separate T-shaped hook 238 to pull the cable 202.

Upon implementation, the device 10 secures, protects, and defends when a shelter-in-place or lockdown situation occurs. The device 10 turns a room (classroom, office, and the like) into a room safe from intruders, especially active shooters, and allows individuals or multiple persons to shelter-in-place. The device 10 adds three layers of security to the first layer of security of an already-existing closed and (perhaps) locked door 90. Thus, the device 10 provides four levels of protection: a locked door 90, a ballistic panel 20, a "secondary" door created by the lever-locking mechanism or the twist-lock mechanism 170 securing the panel 20 against or within the door frame 98, and a cover 50 over the door knob 92 to secure the door 90 and corresponding doorway.

The device 10 is designed to be user friendly. The wheels 4 render the device 10 mobile and allow the user to place the device anywhere in a room, quickly and easily, especially when the device 10 must be placed against a door 90 to perform its safety function. The grips 12 allow the user to easily maneuver the device 10. Once the device 10 is placed in position at a doorway, the user follows the instructions 26 adhered to the device 10 to assure correct use of the device 10. Of course, it would be preferable for the user to have already read the instructions 26 and practiced use of the device 10 before an emergency situation arises. The device 10 provides an uncomplicated, high-quality, physics-based lockdown solution at an affordable price, even for facilities on a limited budget. The device 10 is designed for use in schools, offices, places of worship, and other public facilities where multiple types of doorways are used and overall cost is a major factor.

Although illustrated and described above with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A defense mobile device for securing a door located in a door frame, the device comprising:

a base configured to support the storage of items;

a plurality of wheels affixed to and supporting the base, allowing the device to be moved and maneuvered by a user;

a stop that, when activated, holds the device in a stationary position;

a frame attached to the base;

at least one grip attached to the frame and adapted to be grasped by a user to move and manipulate the device;

a mechanical pivot attached to the base;

a panel having a rear face, an intermediate ballistic core, and a front face, the panel connected to the base via the mechanical pivot and configured to pivot between a plurality of angled positions and an upright position flat against the door; and a locking rod rotatably connected at one of its ends to the base via a first hinge bolt and at its opposite end to the panel via a second hinge bolt, the locking rod pushing and pulling the panel between its angled positions and its upright position.

2. The device according to claim 1 further comprising a portal defined by a ballistic door viewer or a ballistic viewport that is located in the panel and permits viewing or observing through the panel.

3. The device according to claim 2 wherein the portal is a ballistic viewport that includes a border which surrounds and supports a transparent ballistic glass or fiberglass insert.

4. The device according to claim 1 further comprising a release system configured to deactivate the stop and enable the device to move.

5. The device according to claim 4 wherein the release system includes a cable, a tube, a box, and a key.

6. The device according to claim 5 wherein:

the tube defines an inside and has a first end attached to the base of the device proximate to the stop and a second end attached to the box, the cable has two ends, one end attached to the stop such that a pulling force applied to the one end deactivates the stop and a free end opposite the one end, the cable traversing the inside of the tube from the stop to the inside of the box, and the box defines an inside and is affixed to the panel on the rear face of the panel and over an opening in the panel, the opening configured to permit an authorized entrant to access the free end of the cable that resides in the box, the box having a hatch that closes the box, lies flush with the front face of the panel, and includes a key hole configured to receive the key, the hatch locking the box and preventing access to the cable residing in the box until and unless the hatch is opened using the key.

7. The device according to claim 1 wherein the front face of the panel forms an integral writing surface.

8. The device according to claim 1 further comprising a whiteboard removably positioned against the front face of the panel.

9. The device according to claim 1 wherein the ballistic core of the panel is configured to capture and not deflect bullets and other projectiles via ply-delamination.

10. The device according to claim 1 wherein the ballistic core of the panel includes a steel plate with at least one ballistic control rubber block attached to and covering the steel plate.

11. The device according to claim 1 wherein the ballistic core of the panel is a single AR500 steel sheet.

12. The device according to claim 1 further comprising magnets affixed to the panel and adapted to attach to the door frame.

13. The device according to claim 1 further comprising at least one hydraulic lift connected to the frame or to the locking rod to assist in pushing and pulling the panel between its angled positions and its upright position.

14. The device according to claim 1 further comprising a counterweight on the rear face of the panel to achieve proper weight distribution.

15. The device according to claim 1 further comprising one of a lever-locking mechanism or a twist-lock mechanism configured to secure the device in place against or within the door frame and against the door.

16. The device according to claim 1 wherein the door has a door knob and the panel has an opening through the panel from the front face to the rear face, and the device further comprises a cover positioned over the opening on the rear face of the panel and configured to overlay and enclose the door knob when the door knob protrudes through the opening in the panel.

17. The device according to claim 16 wherein the frame has a cutout to accommodate the cover.

18. A defense mobile device for securing a door located in a door frame, the device comprising:

a base configured to support the storage of items;

a plurality of wheels affixed to and supporting the base, allowing the device to be moved and maneuvered by a user;

a stop that, when activated, holds the device in a stationary position;

a frame attached to the base;

at least one grip attached to the frame and adapted to be grasped by a user to move and manipulate the device;

a mechanical pivot attached to the base;

a panel having a rear face, an intermediate ballistic core, and a front face, the panel connected to the base via the mechanical pivot and configured to pivot between a plurality of angled positions and an upright position flat against the door;

a locking rod rotatably connected at one of its ends to the base via a first hinge bolt and at its opposite end to the panel via a second hinge bolt, the locking rod pushing and pulling the panel between its angled positions and its upright position;

a portal defined by a ballistic door viewer or a ballistic viewport that is located in the panel and permits viewing or observing through the panel; and a release system configured to deactivate the stop and enable the device to move.

19. The device according to claim 18 wherein the portal is a ballistic viewport that includes a border which surrounds and supports a transparent ballistic glass or fiberglass insert.

20. The device according to claim 18 wherein the release system includes a cable, a tube, a box, and a key.

* * * * *